US007794316B2

(12) United States Patent
Palmer et al.

(10) Patent No.: US 7,794,316 B2
(45) Date of Patent: Sep. 14, 2010

(54) GAMING DEVICE HAVING MULTIPLE OFFER AND ACCEPTANCE ROUNDS

(75) Inventors: Gregg J. Palmer, Portland, OR (US); Bayard S. Webb, Sparks, NV (US); Megan Nicole Schlegel, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 1302 days.

(21) Appl. No.: 10/860,889

(22) Filed: Jun. 3, 2004

(65) Prior Publication Data

US 2005/0020342 A1 Jan. 27, 2005

Related U.S. Application Data

(60) Provisional application No. 60/478,111, filed on Jun. 12, 2003.

(51) Int. Cl.
*A63F 9/24* (2006.01)

(52) U.S. Cl. ..... 463/16; 463/25

(58) Field of Classification Search ..... 463/16, 463/25

See application file for complete search history.

(56) References Cited

U.S. PATENT DOCUMENTS

| | | | |
|---|---|---|---|
| 3,559,993 | A | 2/1971 | Thomas |
| 3,770,277 | A | 11/1973 | Cass |
| 4,363,489 | A | 12/1982 | Chodak et al. |
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,178,390 | A | 1/1993 | Okada |
| 5,205,555 | A | 4/1993 | Hamano |
| 5,342,047 | A | 8/1994 | Heidel et al. |
| 5,456,465 | A | 10/1995 | Durham |
| 5,511,781 | A | 4/1996 | Wood et al. |
| 5,524,888 | A | 6/1996 | Heidel |
| 5,536,016 | A | 7/1996 | Thompson |

(Continued)

FOREIGN PATENT DOCUMENTS

EP 0874337 A1 10/1998

(Continued)

OTHER PUBLICATIONS

A Vamp for All Seasons Article, written by Strictly Slots, published in 2002.

(Continued)

*Primary Examiner*—Dmitry Suhol
*Assistant Examiner*—Andrew Kim
(74) *Attorney, Agent, or Firm*—K&L Gates LLP

(57) ABSTRACT

A gaming device which provides a plurality of multi-component offers to a player and displays each offer to the player. Each multi-component offer includes a plurality of components having sub-components. The player can independently accept each component. Once a player accepts a component, the player receives a value based on the sub-components associated with that accepted component. The player continues to play the bonus game until the player has accepted all of the components in the offers or until there are no offers remaining. The gaming device then provides an award to the player based on the values of the accepted components of the offers.

84 Claims, 20 Drawing Sheets

U.S. PATENT DOCUMENTS

| | | | | |
|---|---|---|---|---|
| 5,542,669 | A | 8/1996 | Charron et al. | |
| 5,560,603 | A | 10/1996 | Seelig et al. | |
| 5,611,535 | A | 3/1997 | Tiberio | |
| 5,711,525 | A | 1/1998 | Breeding | |
| 5,769,716 | A | 6/1998 | Saffari et al. | |
| 5,772,509 | A | 6/1998 | Weiss | |
| 5,775,692 | A | 7/1998 | Watts et al. | |
| 5,788,573 | A | 8/1998 | Baerlocher et al. | |
| 5,823,874 | A | 10/1998 | Adams | |
| 5,833,538 | A | 11/1998 | Weiss | |
| 5,848,932 | A | 12/1998 | Adams | |
| 5,851,148 | A | 12/1998 | Brune et al. | |
| 5,873,781 | A | 2/1999 | Keane | |
| 5,882,261 | A | 3/1999 | Adams | |
| 5,890,963 | A | 4/1999 | Yen | |
| 5,902,184 | A | 5/1999 | Bennett et al. | |
| 5,911,418 | A | 6/1999 | Adams | |
| 5,947,820 | A | 9/1999 | Morro et al. | |
| 5,951,397 | A | 9/1999 | Dickinson | |
| 5,964,463 | A | 10/1999 | Moore, Jr. | |
| 5,967,894 | A | 10/1999 | Kinoshita et al. | |
| 5,980,384 | A | 11/1999 | Barrie | |
| 5,984,781 | A | 11/1999 | Sunaga | |
| 5,997,400 | A | 12/1999 | Seelig et al. | |
| 5,997,401 | A | 12/1999 | Crawford | |
| 6,004,207 | A | 12/1999 | Wilson, Jr. et al. | |
| 6,015,346 | A * | 1/2000 | Bennett | 463/20 |
| 6,019,369 | A | 2/2000 | Nakagawa et al. | |
| 6,033,307 | A | 3/2000 | Vancura | |
| 6,056,642 | A | 5/2000 | Bennett | |
| 6,059,289 | A | 5/2000 | Vancura | |
| 6,059,658 | A | 5/2000 | Mangano et al. | |
| 6,062,980 | A | 5/2000 | Luciano | |
| 6,089,976 | A | 7/2000 | Schneider et al. | |
| 6,089,977 | A | 7/2000 | Bennett | |
| 6,089,978 | A | 7/2000 | Adams | |
| 6,093,102 | A | 7/2000 | Bennett | |
| 6,102,798 | A | 8/2000 | Bennett | |
| 6,120,031 | A | 9/2000 | Adams | |
| 6,126,541 | A | 10/2000 | Fuchs | |
| 6,126,542 | A | 10/2000 | Fier | |
| 6,142,873 | A | 11/2000 | Weiss et al. | |
| 6,142,874 | A | 11/2000 | Kodachi et al. | |
| 6,142,875 | A | 11/2000 | Kodachi et al. | |
| 6,146,273 | A | 11/2000 | Olsen | |
| 6,159,095 | A | 12/2000 | Frohm et al. | |
| 6,159,096 | A | 12/2000 | Yoseloff | |
| 6,159,097 | A | 12/2000 | Gura | |
| 6,159,098 | A | 12/2000 | Slomiany et al. | |
| 6,162,121 | A | 12/2000 | Morro et al. | |
| 6,168,520 | B1 | 1/2001 | Baerlocher et al. | |
| 6,168,523 | B1 | 1/2001 | Piechowiak et al. | |
| 6,173,955 | B1 | 1/2001 | Perrie et al. | |
| 6,174,233 | B1 | 1/2001 | Sunaga et al. | |
| 6,174,235 | B1 | 1/2001 | Walker et al. | |
| 6,189,886 | B1 | 2/2001 | Moran | |
| 6,190,254 | B1 | 2/2001 | Bennett | |
| 6,190,255 | B1 | 2/2001 | Thomas et al. | |
| 6,203,429 | B1 | 3/2001 | Demar et al. | |
| 6,210,279 | B1 | 4/2001 | Dickinson | |
| 6,213,876 | B1 | 4/2001 | Moore, Jr. | |
| 6,224,483 | B1 | 5/2001 | Mayeroff | |
| 6,231,442 | B1 | 5/2001 | Mayeroff | |
| 6,231,445 | B1 | 5/2001 | Acres | |
| 6,261,177 | B1 | 7/2001 | Bennett | |
| 6,302,790 | B1 | 10/2001 | Brossard | |
| 6,305,686 | B1 | 10/2001 | Perrie et al. | |
| 6,309,300 | B1 | 10/2001 | Glavich | |
| 6,328,649 | B1 | 12/2001 | Randall et al. | |
| 6,375,187 | B1 * | 4/2002 | Baerlocher | 273/143 R |
| 6,398,218 | B1 | 6/2002 | Vancura | |
| 6,413,160 | B1 | 7/2002 | Vancura | |
| 6,413,161 | B1 | 7/2002 | Baerlocher et al. | |
| 6,435,511 | B1 | 8/2002 | Vancura et al. | |
| 6,439,995 | B1 | 8/2002 | Hughs-Baird et al. | |
| 6,461,241 | B1 | 10/2002 | Webb et al. | |
| 6,464,582 | B1 | 10/2002 | Baerlocher et al. | |
| 6,494,785 | B1 | 12/2002 | Gerrard et al. | |
| 6,506,118 | B1 | 1/2003 | Baerlocher et al. | |
| 6,514,141 | B1 | 2/2003 | Kaminkow et al. | |
| 6,561,899 | B2 | 5/2003 | Vancura | |
| 6,569,015 | B1 | 5/2003 | Baerlocher et al. | |
| 6,575,830 | B2 | 6/2003 | Baerlocher et al. | |
| 6,585,591 | B1 | 7/2003 | Baerlocher et al. | |
| 6,595,854 | B2 | 7/2003 | Hughs-Baird et al. | |
| 6,599,192 | B1 | 7/2003 | Baerlocher et al. | |
| 6,620,045 | B2 | 9/2003 | Berman et al. | |
| 6,632,141 | B2 | 10/2003 | Webb et al. | |
| 6,648,754 | B2 | 11/2003 | Baerlocher et al. | |
| 6,659,864 | B2 | 12/2003 | McGahn et al. | |
| 6,692,355 | B2 | 2/2004 | Baerlocher et al. | |
| 6,719,632 | B2 | 4/2004 | Palmer et al. | |
| 6,722,981 | B2 | 4/2004 | Kaminkow et al. | |
| 6,722,982 | B2 | 4/2004 | Kaminkow et al. | |
| 6,758,750 | B2 | 7/2004 | Baerlocher et al. | |
| 6,786,820 | B2 | 9/2004 | Gerrard et al. | |
| 6,793,579 | B2 | 9/2004 | Baerlocher et al. | |
| 6,796,905 | B2 | 9/2004 | Baerlocher et al. | |
| 6,808,452 | B2 | 10/2004 | Baerlocher et al. | |
| 6,808,454 | B2 | 10/2004 | Gerrard et al. | |
| 6,811,483 | B1 | 11/2004 | Webb et al. | |
| 6,852,030 | B2 | 2/2005 | Baerlocher et al. | |
| 6,890,257 | B2 | 5/2005 | Baerlocher | |
| 6,899,623 | B2 | 5/2005 | Baerlocher | |
| 6,942,566 | B2 | 9/2005 | Baerlocher et al. | |
| 6,942,567 | B2 | 9/2005 | Baerlocher et al. | |
| 6,960,132 | B2 | 11/2005 | Baerlocher et al. | |
| 6,966,833 | B2 | 11/2005 | Kaminkow et al. | |
| 6,971,953 | B2 | 12/2005 | Gerrard et al. | |
| 7,001,273 | B2 | 2/2006 | Baerlocher | |
| 2002/0045475 | A1 | 4/2002 | Glavich et al. | |
| 2002/0072402 | A1 | 6/2002 | Baerlocher | |
| 2002/0142821 | A1 * | 10/2002 | Baerlocher | 463/16 |
| 2002/0142822 | A1 | 10/2002 | Baerlocher et al. | |
| 2002/0151350 | A1 | 10/2002 | Baerlocher et al. | |
| 2002/0155883 | A1 | 10/2002 | Baerlocher | |
| 2002/0187827 | A1 | 12/2002 | Blankstein | |
| 2003/0013514 | A1 | 1/2003 | Cregan et al. | |
| 2003/0040355 | A1 | 2/2003 | Baerlocher | |
| 2003/0040360 | A1 | 2/2003 | Kaminkow | |
| 2003/0045344 | A1 | 3/2003 | Webb et al. | |
| 2003/0045348 | A1 | 3/2003 | Palmer et al. | |
| 2003/0045350 | A1 | 3/2003 | Baerlocher et al. | |
| 2003/0060260 | A1 | 3/2003 | Gerrard et al. | |
| 2003/0064795 | A1 | 4/2003 | Baerlocher et al. | |
| 2003/0078093 | A1 | 4/2003 | Simms et al. | |
| 2003/0087693 | A1 | 5/2003 | Baerlocher et al. | |
| 2003/0090063 | A1 | 5/2003 | Jarvis et al. | |
| 2003/0157982 | A1 | 8/2003 | Gerrard et al. | |
| 2003/0162584 | A1 | 8/2003 | Hughs-Baird et al. | |
| 2003/0211880 | A1 | 11/2003 | Locke | |
| 2004/0009805 | A1 | 1/2004 | Baerlocher et al. | |
| 2004/0023707 | A1 | 2/2004 | Maya et al. | |
| 2004/0038729 | A1 | 2/2004 | Webb et al. | |
| 2004/0106444 | A1 | 6/2004 | Cuddy et al. | |
| 2004/0162128 | A1 | 8/2004 | Baerlocher et al. | |
| 2004/0180710 | A1 | 9/2004 | Palmer et al. | |
| 2004/0185928 | A1 | 9/2004 | Baerlocher et al. | |
| 2004/0214632 | A1 | 10/2004 | Cuddy et al. | |
| 2005/0020346 | A1 | 1/2005 | Baerlocher | |
| 2005/0032567 | A1 | 2/2005 | Baerlocher et al. | |
| 2005/0037829 | A1 | 2/2005 | Baerlocher et al. | |
| 2005/0049036 | A1 | 3/2005 | Mead | |
| 2005/0054413 | A1 | 3/2005 | Randall et al. | |

| | | | |
|---|---|---|---|
| 2005/0055115 | A1 | 3/2005 | Gerrard et al. |
| 2005/0101375 | A1 | 5/2005 | Webb et al. |
| 2005/0130729 | A1 | 6/2005 | Baerlocher et al. |
| 2005/0153767 | A1 | 7/2005 | Gauselmann |
| 2005/0187010 | A1 | 8/2005 | Baerlocher |
| 2005/0266914 | A1 | 12/2005 | Baerlocher et al. |
| 2006/0003837 | A1 | 1/2006 | Baerlocher et al. |

FOREIGN PATENT DOCUMENTS

| | | | |
|---|---|---|---|
| EP | 0926645 | A2 | 6/1999 |
| EP | 0944030 | A2 | 9/1999 |
| EP | 0945837 | A2 | 9/1999 |
| EP | 0981119 | A2 | 2/2000 |
| EP | 0984408 | A2 | 3/2000 |
| EP | 0984409 | A2 | 3/2000 |
| EP | 1298609 | A2 | 4/2003 |
| EP | 1175928 | A2 | 7/2004 |
| WO | WO 9732285 | | 9/1997 |
| WO | WO 00/12186 | | 3/2000 |

OTHER PUBLICATIONS

Addams Family Article, written by Strictly Slots, published in 2000.
American Bandstand Article, written by Strictly Slots, published in 2002.
By George Advertisement, written by IGT, published in 2002.
Cash for Life—Offer Bonus Advertisement/Lotsa Loot Advertisement/Take It or Leave It Advertisement, written by Bally Gaming, published in 2002.
Cash for Life—Triple Spin Bonus Article, written by Strictly Slots, published in 2003.
Deep Pockets Advertisement, written by IGT, published in 2002.
Deep Pockets Article, written by Strictly Slots, published in 2002.
Double Top Dollar Advertisement, written by IGT, published in 2003.
Fire and Fortune Article, written by Strictly Slots, published in 2001.
Hollywood Advertisement, written by Shuffle Master Gaming, published in 2001.
King Cash Slots Advertisement, written by IGT, published in 2003.
Let's Make A Deal Advertisements written by Bally Gaming/Shuffle Master Gaming, published in 2001.
Press Your Luck Advertisement, written by Shuffle Master Gaming, published in 2000.
Press Your Luck Article, written by Strictly Slots, published in 2000.
Price is Right—Cliff Hangers Description, printed from www.geocities.com (web site) on Mar. 21, 2001.
Price is Right—Cliff Hangers Advertisement, written by IGT, published in 2001.
Price is Right—Showcases Description, printed from schuminweb.com (web site) on Mar. 16, 2001.
Psycho Cash Beast Advertisement, written by IGT, published in 1999.
Take Your Pick Advertisement, written by IGT/Anchor Gaming, published in 1999.
Take Your Pick Article, written by Strictly Slots, published in Mar. 2001.
Three Wishes Article, written by Strictly Slots, published in 2000.
Top Dollar Game Advertisement, written by IGT, published in 1998.

* cited by examiner

GAMING DEVICE HAVING MULTIPLE OFFER AND ACCEPTANCE ROUNDS

PRIORITY CLAIM

This application is a non-provisional application of, claims priority to and the benefit of U.S. Provisional Patent Application Ser. No. 60/478,111, filed on Jun. 12, 2003, which incorporated herein in its entirety.

CROSS REFERENCE TO RELATED APPLICATIONS

This application is related to the following commonly-owned co-pending patent applications:

"GAMING DEVICE HAVING A BONUS ROUND WITH MULTIPLE RANDOM AWARD GENERATION AND MULTIPLE RETURN/RISK SCENARIOS," Ser. No. 09/678,989; "GAMING DEVICE HAVING AN AWARD EXCHANGE BONUS ROUND AND METHOD FOR REVEALING AWARD EXCHANGE POSSIBILITIES," Ser. No. 09/689,510; "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601; "GAMING DEVICE HAVING AN IMPROVED OFFER/ACCEPTANCE BONUS SCHEME," Ser. No. 09/966,884; "GAMING DEVICE HAVING OFFER AND ACCEPTANCE GAME WITH HIDDEN OFFER," Ser. No. 10/160,688; "GAMING DEVICE HAVING OFFER/ACCEPTANCE ADVANCE THRESHOLD AND LIMIT BONUS SCHEME," Ser. No. 09/838,014; "GAMING DEVICE HAVING IMPROVED OFFER AND ACCEPTANCE GAME WITH MASKED OFFERS," Ser. No. 10/086,014; "GAMING DEVICE HAVING AN AWARD OFFER AND TERMINATION BONUS SCHEME," Ser. No. 09/682,428; "GAMING DEVICE HAVING AN OFFER AND ACCEPTANCE GAME WITH A PLAYER SELECTION FEATURE," Ser. No. 10/086,078; "GAMING DEVICE HAVING OFFER AND ACCEPTANCE GAME WITH A PLURALITY OF AWARD POOLS, A REVEAL FEATURE, AND A MODIFY FEATURE," Ser. No. 10/255,862; "GAMING DEVICE HAVING IMPROVED OFFER AND ACCEPTANCE BONUS SCHEME," Ser. No. 10/074,273; "GAMING DEVICE HAVING AN OFFER/ACCEPTANCE GAME WITH MULTI-OFFER SYMBOL," Ser. No. 10/245,387; "GAMING DEVICE HAVING AN OFFER/ACCEPTANCE GAME WHEREIN EACH OFFER IS BASED ON A PLURALITY OF INDEPENDENTLY GENERATED EVENTS," Ser. No. 10/244,134; "GAMING DEVICE HAVING A DESTINATION PURSUIT BONUS SCHEME WITH ADVANCED AND SETBACK CONDITIONS," Ser. No. 10/288,750; "GAMING DEVICE HAVING IMPROVED AWARD OFFER BONUS SCHEME," Ser. No. 10/290,800; "GAMING DEVICE HAVING VALUE SELECTION BONUS," Ser. No. 10/306,295; "GAMING DEVICE HAVING IMPROVED AWARD OFFER BONUS SCHEME," Ser. No. 10/318,752; "GAMING DEVICE HAVING A DESTINATION PURSUIT BONUS SCHEME WITH ADVANCED AND SETBACK CONDITIONS," Ser. No. 10/393,201"GAMING DEVICE HAVING VALUE SELECTION BONUS," Ser. No. 10/354,514; "GAMING DEVICE HAVING SEPARATELY CHANGEABLE VALUE AND MODIFIER BONUS SCHEME," Ser. No. 10/410,019; "GAMING DEVICE HAVING RISK EVALUATION BONUS ROUND," Ser. No. 10/616,563; "GAMING DEVICE HAVING RISK EVALUATION BONUS ROUND," Ser. No. 10/454,337; "GAMING DEVICE HAVING AN OFFER AND ACCEPTANCE SELECTION BONUS SCHEME WITH A TERMINATOR AND AN ANTI-TERMINATOR," Ser. No. 10/644,447; "GAMING DEVICE HAVING AN AWARD EXCHANGE BONUS ROUND AND METHOD FOR REVEALING AWARD EXCHANGE POSSIBILITIES," Ser. No. 10/629,416; "GAMING DEVICE HAVING OFFER ACCEPTANCE GAME WITH TERMINATION LIMIT," Ser. No. 10/678,656; and "GAMING DEVICE HAVING SEPARATELY CHANGEABLE VALUE AND MODIFIER BONUS SCHEME," Ser. No. 10/767,484.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device and more particularly to a gaming device having multiple offer and acceptance rounds.

Gaming device manufacturers strive to make gaming devices that provide as much enjoyment and excitement as possible. Providing a secondary or bonus game in which a player has an opportunity to win potentially large awards or credits in addition to the awards associated with the primary or base game of the gaming device is one way to enhance player enjoyment and excitement.

Gaming devices having bonus games generally employ a triggering event that occurs during the base game. The triggering event temporarily stalls or halts the base game play and enables a player to enter a second, different game, which is the bonus game. The player plays the bonus game, likely receives an award and returns to the base game.

One known bonus game enables players to accept or decline multiple award offers. The TOP DOLLAR® gaming device which is manufactured and distributed by the assignee of this application, provides the player with three offers and a final award. When an offer is given, the player may accept or reject it by pushing an accept button or a reject button, respectively. If the player accepts an offer, the player receives the accepted bonus amount and the bonus round terminates. If the player declines an offer, the game generates another offer for the player. The player is automatically provided with the last selected offer if the player rejects the three previous offers.

In this known offer/acceptance game, when the player rejects an offer, the player risks a current or guaranteed award for a higher value award. The game may instead provide a lower award. The game thus creates a risk for the player. Enabling a player to pick from different risk based alternatives and then enabling the player to accumulate awards or offers from the selected alternatives provides excitement and enjoyment to the player. Therefore a need exists to provide an offer/acceptance game that enables a player to weigh options and explore the consequences of selecting those options where the player may accumulate awards or offers.

SUMMARY OF THE INVENTION

The present invention provides a gaming device and specifically a bonus game of a gaming device including a plurality of multi-component or multi-part offers. Each multi-component offer has a plurality of offer components, which are simultaneously provided to a player. A display device displays the offers to a player. In one embodiment, each offer component includes a plurality of sub-components. That is, a plurality of sub-components form each offer component and a plurality of offer components form each multi-component offer of the game of the present invention. The gaming device enables the player to independently accept the components of each of the offers. If the player does not independently accept a component of an offer, the component may, independently of the other components of the offer, increase, decrease or remain unchanged in the next offer. In one embodiment, one of the sub-components of each offer component independently changes to form the offer components of the next offer. In another embodiment, a plurality of the sub-components change. In a further embodiment, all of the sub-components change.

The player continues to independently accept the components of each multi-component offer until a predetermined number of components are accepted, until all of the components in the game are accepted by the player or until there are no multi-component offers remaining in the game. In one embodiment, the previously unaccepted components are automatically accepted in the last multi-component offer. The gaming device then provides a value associated with each accepted offer component wherein the value of each accepted offer component is based on the sub-components of the accepted offer component. The gaming device provides an award to the player based on the values of the accepted components in each of the offers.

More specifically, in one embodiment, each component includes one fixed value sub-component and one variable value sub-component where the variable value may increase or decrease by a fixed or random amount or remain unchanged in each consecutive offer. It should be appreciated that the overall number of offers provided to the player may be predetermined or randomly determined.

In one illustrative embodiment, each multi-component offer includes a plurality of components, which represent values of a plurality of specific stocks in a stock portfolio at different times during the day. An offer display displays at least two stocks selected from the plurality of stocks. Each component (i.e., each specific stock in the stock portfolio) includes two sub-components. The first sub-component is a fixed value and represents a number of shares of stock "owned by the player." The number of shares may be predetermined or randomly determined by a processor. The second sub-component is a variable value which represents the price for each stock in this illustrative example.

In one preferred embodiment, each component changes or potentially changes with each new multi-component offer. That is, the value of each specific stock changes or potentially changes at different times during the day. The value of each stock is the number of shares multiplied by the price for the stock. The gaming device displays one multi-component offer at a time to the player. The player may independently accept (i.e., sell a stock), or reject (i.e., hold a stock) each component of each offer. Once a player accepts a component in a multi-component offer (i.e., sells the stock at a desired stock price), the player receives a value for that stock which equals the second sub-component (i.e., the accepted stock price) multiplied by the first sub-component (i.e., the number of shares for that stock). The player continues to play the game until the player has accepted each component (i.e., sold each stock at a desired stock price), or until there are no multi-component offers remaining in the game. Once the game ends, the player's total award is the total portfolio value of the stocks, which equals the sum of each accepted stock price multiplied by the number of shares corresponding to those stock prices. In another embodiment, the total award is based on predetermined or randomly determined awards associated with the stocks.

In one embodiment, the stock prices in each multi-component offer are randomly selected from a plurality of stock prices. In another embodiment, the stock prices are associated with ranges such that the price of a particular stock may only be one of the values in the associated range of stock prices.

In a further embodiment, each stock price is associated with a range of values including positive numbers (i.e., +1, +2), negative numbers (i.e., −1, −2) and zero. In one embodiment, the range is different for each stock. The gaming device may or may not inform the player of these changes. A positive value, negative value, or zero is selected in each offer. The stock price is increased by a selected positive value, decreased by selected negative value and unchanged if zero is selected from the range of values. In another embodiment, each stock price is increased or decreased by a percentage of the stock's current price. For example, a stock valued at $50 may increase 10% rather than increasing $5. In one aspect of this embodiment, the average modification value is zero or approximately zero so that a particular stock price will on average remain unchanged during a bonus game.

In another embodiment of the present invention, the first sub-component of one or more offer components (i.e., the number of stock shares) may split during the game. A stock split modifies the number of shares for a particular stock or stocks. After a stock split, the number of shares may increase or decrease by a predetermined value or multiplier, or increase or decrease by a random value or multiplier or change based on an associated range.

In a further embodiment, the stock prices or price range for each stock is displayed in a value component display such as a stock price display. The stock price display displays a price range such as the fifty-two week high and low stock prices or stock price summary for each stock. This display or table enables a player to view the stock price trends for each stock and helps the player to determine when to accept or reject a stock price or value component for a particular stock.

In an alternative embodiment of the present invention, one or more multi-component offers including a plurality of offer components are displayed to a player. Each component includes a first sub-component and a second sub-component. The first sub-component represents an outcome to a question, hint or other prompt that is presented to the player wherein the first sub-component or outcome changes in each offer. The second sub-component is a variable value or award which is associated with the first sub-component. The value of the second sub-component changes when the outcome associated with the first sub-component changes in each offer. The player determines whether to accept or reject the components in the offers based on the sub-components associated with each component. If the player accepts a component in an offer, the player receives the value or award associated with that component. In one aspect of this embodiment, if the player rejects the answer for one or more of the questions, the gaming device enables the player to enter or input an answer in the subsequent offer. The player may use an input or input device such as a keyboard or touch screen to enter their answer. The player continues to accept or reject components in the offers until all of the components have been accepted or until there are no offers remaining.

Although the present invention is primarily discussed relative to a bonus game of a gaming device, it should be appreciated that the present invention could be employed as a primary game in a gaming device.

It is therefore an advantage of the present invention to provide a gaming device having multiple offer and acceptance opportunities in a game.

A further advantage of the present invention is to provide a gaming device having a game that enables players to independently accept or reject components of an offer.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
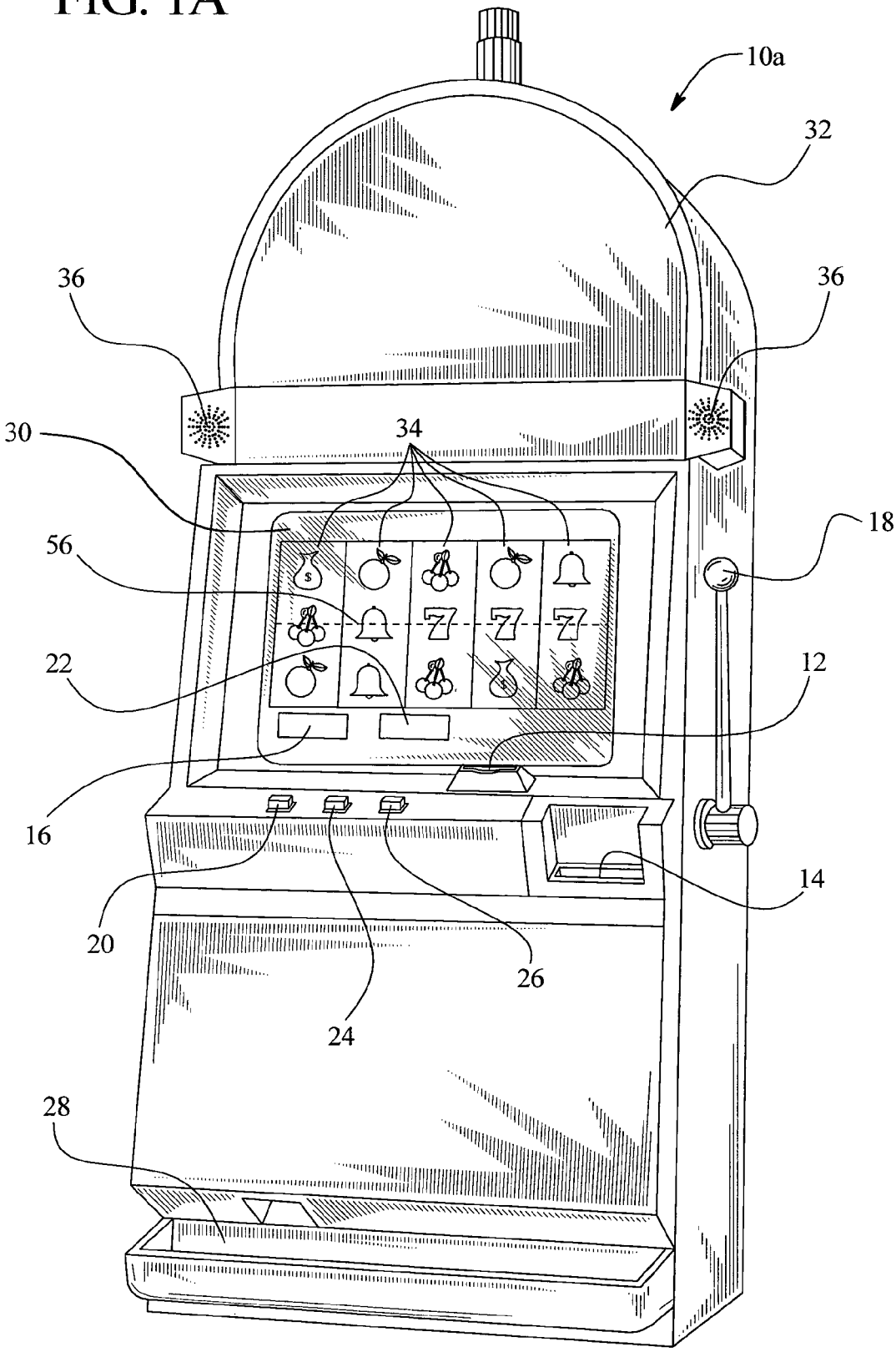
FIG. 1A is a front perspective view of one embodiment of the gaming device of the present invention.
Figure 1B:
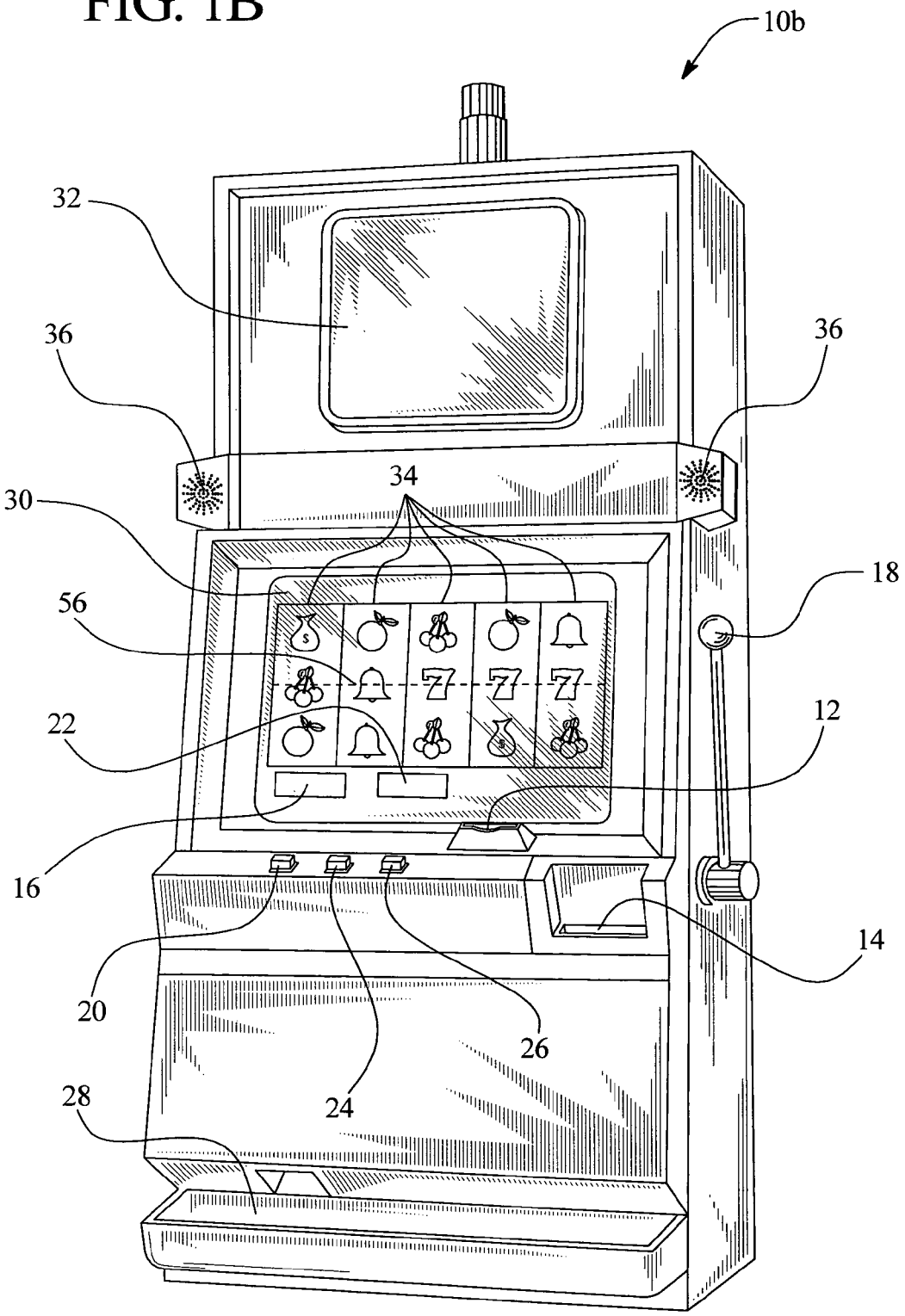
FIG. 1B is a front perspective of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. Gaming device 10 can be constructed with varying cabinet and display configurations, as illustrated by the different configurations shown in FIGS. 1A and 1B.

Figure 2:
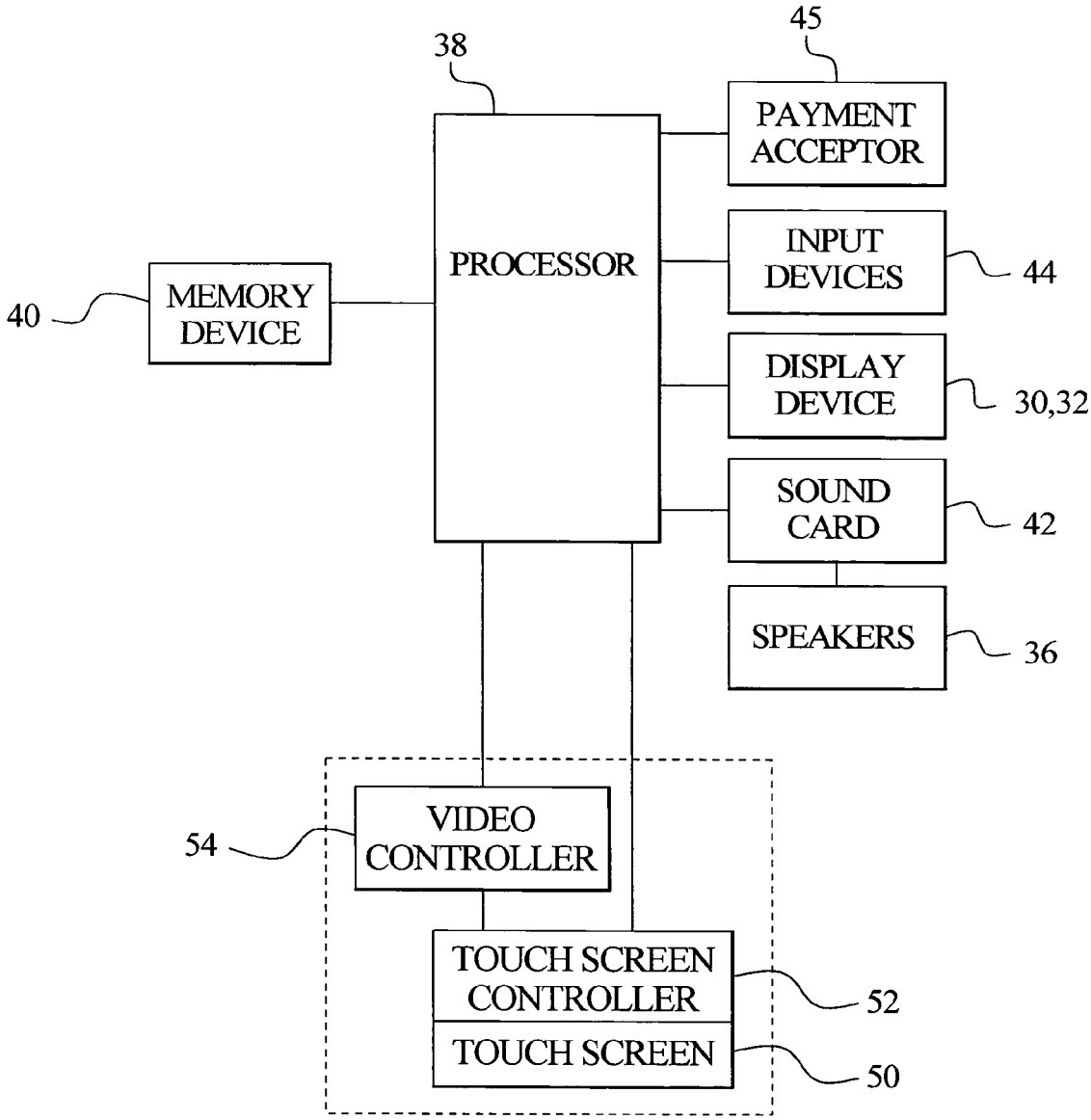
FIG. 2 is a schematic block diagram of the electronic configuration of one embodiment of the gaming device of the present invention.

In one embodiment, as illustrated in FIG. 2, the gaming device preferably includes at least one processor 38, such as a microprocessor, a microcontroller-based platform, a suitable integrated circuit or one or more application-specific integrated circuits (ASIC's). The processor is in communication with or operable to access or to exchange signals with at least one data storage or memory device 40. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or other operating data, information and applicable game rules that relate to the play of the gaming device. In another embodiment, the memory device includes random access memory (RAM). In one embodiment, the memory device includes read only memory (ROM). In a further embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. In this type of embodiment, the gaming device provides players with all of the available awards or other game outcomes over the course of the play cycle and guarantees a designated amount of actual wins and losses.

In one embodiment, gaming device 10 includes one or more display devices controlled by the processor. The display devices are preferably connected to or mounted to the cabinet of the gaming device. The embodiment shown in FIG. 1A includes a central display device 30 which displays a primary game. This display device may also display any suitable secondary game associated with the primary game as well as information relating to the primary or secondary game. The alternative embodiment shown in FIG. 1B includes a central display device 30 and an upper display device 32. The upper display device may display the primary game, any suitable secondary game associated with the primary game and/or information relating to the primary or secondary game. As seen in FIGS. 1A and 1B, in one embodiment, the gaming device includes a credit display 16 which displays a player's current number of credits, cash, account balance or the equivalent. In one embodiment, the gaming device includes a bet display 22 which displays a player's amount wagered.

The display devices may include, without limitation, a monitor, a television display, a plasma display, a liquid crystal display (LCD), a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of games or other suitable images, symbols and indicia such as any visual representation or exhibition of the movement of objects such as mechanical, virtual or video reels and wheels, dynamic lighting, video images and images of people, characters, places, things and faces of cards, tournament advertisements, promotions and the like.

In one alternative embodiment, the symbols, images and indicia displayed on or by the display device may be in mechanical form. That is, the display device may include any suitable electromechanical device which preferable moves one or more mechanical objects, such as one or more mechanical rotatable wheels, reels or dice, configured to display at least one and preferably a plurality of games or other suitable images, symbols or indicia.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display device may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, as seen in FIG. 2, the gaming device includes a sound generating device controlled by one or more sounds cards 42 which function in conjunction with the processor. In one embodiment, the sound generating device includes at least one and preferably a plurality of speakers 36 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

As illustrated in FIG. 2, in one embodiment, the gaming device includes at least one payment acceptor 45 in communication with the processor. As seen in FIGS. 1A and 1B, the payment acceptor may include a coin slot 12 and a payment, note or bill acceptor 14, where the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2, in one embodiment the gaming device includes at least one and preferably a plurality of input devices 44 in communication with the processor. The input devices can include any suitable device which enables the player to produce an input signal which is read by the processor. In one embodiment, after appropriate funding of the gaming device, the input device is a game activation device, such as a pull arm 18 or a play button 20 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 24. The player places a bet by pushing the bet one button. The player can increase the bet by one credit each time the player pushes the bet one button. When the player pushes the bet one button, the number of credits shown in the credit display preferably decreases by one and the number of credits shown in the bet display preferably increases by one. In another embodiment, one input device is a bet max button (not shown) which enables the player to bet the maximum wager permitted for a game associated with the gaming device.

In one embodiment, one input device is a cash out button 26. The player may push the cash out button and cash out to receive a cash payment or other suitable form of payment corresponding to the number of remaining credits. In one embodiment, when the player cashes out, the player receives the coins or tokens in a coin payout tray 28. In one embodiment, when the player cashes out, the player may receive other payout mechanisms such as tickets or credit slips which are redeemable by a cashier or funded to the player's electronically recordable identification card.

In one embodiment, as mentioned above and seen in FIG. 2, one input device is a touch-screen 50 coupled with a touch-screen controller 52, or some other touch-sensitive display overlay to allow for player interaction with the images on the display. The touch-screen and the touch-screen controller are connected to a video controller 54. A player can make decisions and input signals into the gaming device by touching the touch-screen at the appropriate places.

The gaming device may further include a plurality of communication ports for enabling communication of the processor with external peripherals, such as external video sources, expansion buses, game or other displays, an SCSI port or a key pad.

The gaming device can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation of the game from a wager made by the player. That is, different primary wagering games, such as video poker games, video blackjack games, video keno, video bingo or any other suitable primary or base game may be implemented into the present invention.

In one embodiment, as illustrated in FIGS. 1A and 1B, a base or primary game may be a slot game with one or more paylines 56. The paylines may be horizontal, vertical, circular, diagonal, angled or any combination thereof. In this embodiment, the gaming device displays at least one reel and preferably a plurality of reels 34, such as three to five reels, in either electromechanical form with mechanical rotating reels or in video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, the plurality of simulated video reels are displayed on one or more of the display devices as described above. Each reel displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning combination or pattern.

In one embodiment, a base or primary game may be a poker game wherein the gaming device enables the player to play a conventional game of video poker and initially deals five cards, all face up, from a virtual deck of fifty-two cards. Cards may be dealt as in a traditional game of cards or in the case of the gaming device, the cards may be randomly selected from a predetermined number of cards. If the player wishes to draw, the player selects the cards to hold by using one or more input devices, such as pressing related hold buttons or touching a corresponding area on a touch-screen. After the player presses the deal button, the processor of the gaming device removes the unwanted or discarded cards from the display and deals replacement cards from the remaining cards in the deck. This results in a final five-card hand. The processor of the gaming device compares the final five-card hand to a payout table which utilizes conventional poker hand rankings to determine the winning hands. Award based on a winning hand and the credits wagered is provided to the player.

In another embodiment, the base or primary game may be a multi-hand version of video poker. In this embodiment, the player is dealt at least two hands of cards. In one such embodiment, the cards in all of the dealt hands are the same cards. In one embodiment each hand of cards is associated with its own deck of cards. The player chooses the cards to hold in a primary hand. The held cards in the primary hand are also held in the other hands of cards. The remaining non-held cards are removed from each displayed hand and replaced with randomly dealt cards. Since the replacement cards are randomly dealt independently for each hand, the replacement cards will usually be different for each hand. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferably a plurality of the selectable indicia or numbers by using an input device or by using the touch-screen. The gaming device then displays a series of drawn numbers to determine an amount of matches, if any, between the player's selected numbers and the gaming device's drawn numbers. The player is provided an award, if any, based on the amount of determined matches.

In one embodiment, as discussed in more detail below, in addition to winning credits in a base or primary game, the gaming device may also give players the opportunity to win credits in a bonus or secondary game or bonus or secondary round. The bonus or secondary game enables the player to obtain a bonus prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the gaming device includes a program code which causes the processor to automatically begin a bonus round when the player has achieved a triggering event, a qualifying condition or other designated game event in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be triggered by exceeding a certain amount of game play (number of games, number of credits, amount of time), earning a specified number of points during game play or as a random award.

In one embodiment, once a player has qualified for a bonus game, the player may subsequently enhance their bonus game participation by returning to the base or primary game for continued play. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game. The player must win or earn entry through play of the primary game, thereby encouraging play of the primary game. In another embodiment, qualification of the bonus or secondary game could be accomplished through a simple "buy in" by the player if, for example, the player has been unsuccessful at qualifying for the bonus game through other specified activities.

Figure 2A:
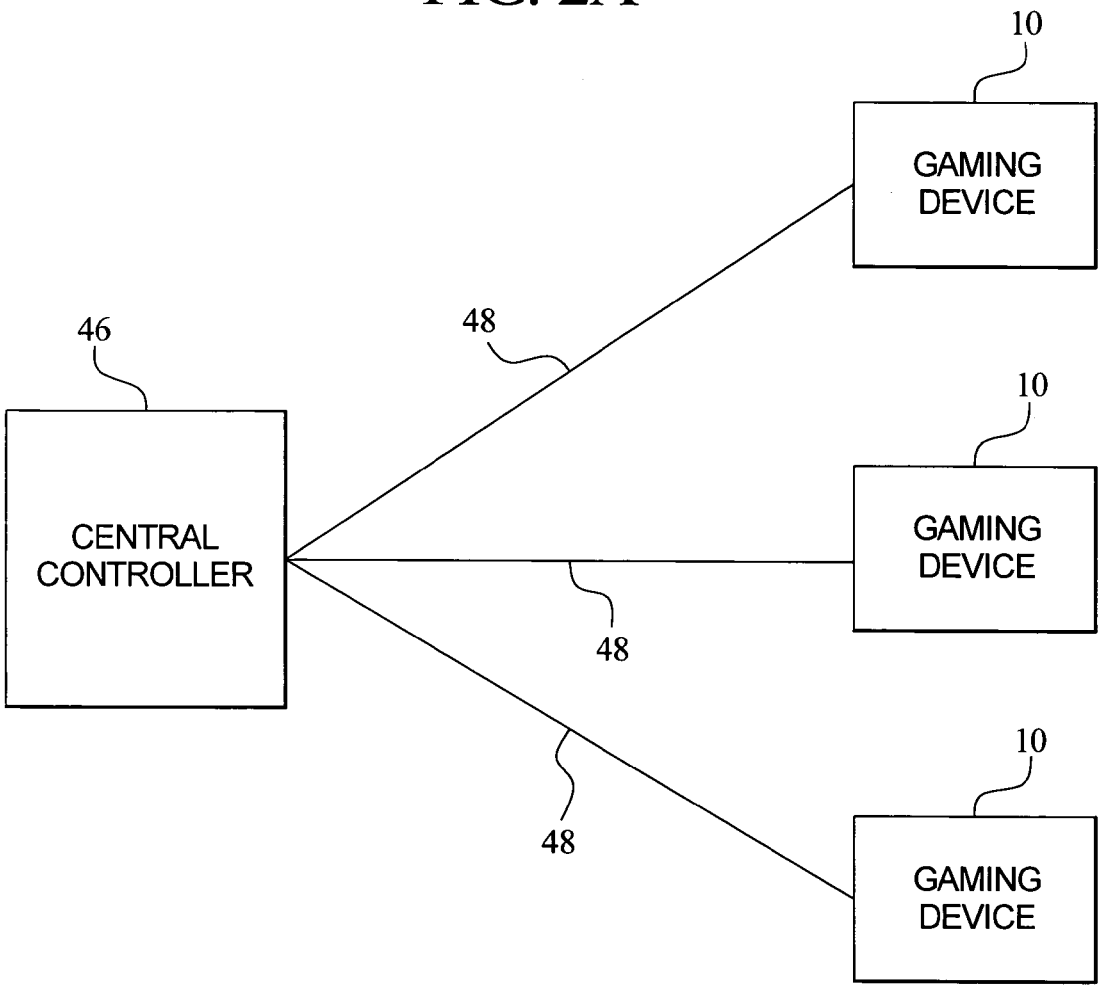
FIG. 2A is a schematic block diagram illustrating a plurality of the gaming devices of the present invention in communication with a central controller.

In one embodiment, as illustrated in FIG. 2A, one or more of the gaming devices 10 of the present invention may be connected to a data network or a remote communication link 48 with some or all of the functions of each gaming device provided at a central location 46 such as a central server or controller. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and/or preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or an on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server or webserver) through a conventional phone or other data transmission line, digital signal line (DSL), T-1 line, coaxial cable, fiber optic cable, wireless gateway or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to and receive information from the host site computer. Each central server computer is responsible for all data communication between the gaming device hardware and software and the host site computer.

Game

The present invention provides a gaming device and specifically, a bonus game of a gaming device including a plurality of multi-component or multi-part offers having a plurality of offer components wherein a player independently accepts or rejects the offer components.

In one embodiment of the present invention, a plurality of multi-component offers are sequentially displayed to a player by a display device. Each multi-component offer includes a plurality of offer components simultaneously displayed to the player. The components further include several sub-components simultaneously displayed to the player. A plurality of values are associated with the components. The values are based on the sub-components. The player may independently accept (or reject) the components in each offer. If the player does not accept (or reject) a component, the component may independently increase, decrease or remain unchanged in the next offer. The player continues to independently accept components in each multi-component offer until a predetermined number of components are accepted, until all of the components in the game are accepted by the player or until there are no multi-component offers remaining in the game. In one embodiment, if the player does not accept a component in any of the offers, the processor automatically accepts the component in the last offer. Each multi-component offer may thus have a same number of components or a different number of components and will generally have a decreasing number of components throughout the game. At the end of the game, the player receives the total value for the game, which is the combination or sum of the values associated with the independently accepted components in the offers. In one embodiment, the gaming device provides the player with an award based on the sum of the values or total value associated with the accepted components.

In one embodiment, the sub-components are independent and unrelated to each other. In another embodiment, the sub-components are related to each other in a suitable manner. In one embodiment, the sub-components include at least one fixed value and at least one variable value. The variable value may increase, decrease or remain unchanged. In one embodiment, the variable value may change by a predetermined amount in each offer. The variable value may also change by a predetermined amount in a plurality of offers. In addition, the variable value may change by a random amount or by an average amount in each offer or in a plurality of offers, wherein the average amount of change is zero or approximately zero.

In one embodiment, the first or variable value is associated with a range of integer values. The range of integer values may be predetermined or randomly determined by the processor. In this embodiment, a probability of being selected by the processor is associated with each integer value in the range of integer values. The processor randomly selects and associates one of the integer values in the range of values with the variable value based on the probabilities. In one embodiment, the range of integer values is displayed to the player by the display device so that the player can determine whether to accept the components in each of the offers based on the ranges. It should be appreciated that one or more variable values may be included in the sub-components.

In a further embodiment, the values of the components change in each multi-component offer or in a plurality of multi-component offers. The processor then calculates the variable value in each offer based on the change in the value of the component which includes the variable value. The award may change by a predetermined amount, a random amount or an average amount, wherein the average amount may be zero or approximately zero.

In the game of the present invention, a player must decide whether to accept one or more components in a multi-component offer. The player may accept a component in an offer using a component acceptor or reject an offer using a component rejector. It should be appreciated that a gaming device may include one or more component acceptors, component rejectors or any combination therein. If the player does not accept or reject the particular component or components in an offer, the component or components may subsequently increase or decrease in value or remain unchanged. Thus, the game involves some risk to the player, which increases the player's excitement and enjoyment of the game.

Figure 3:
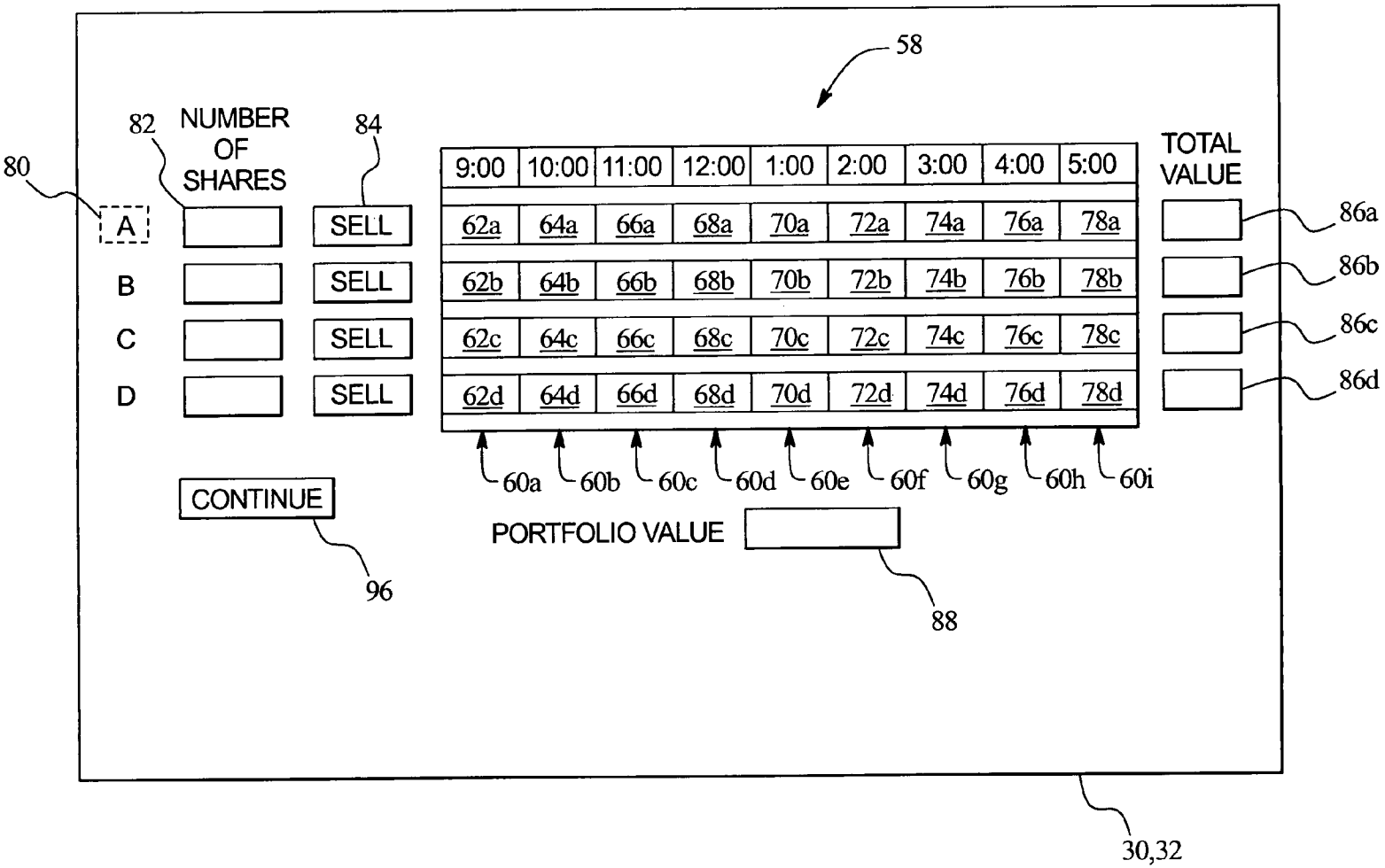
FIG. 3 is an enlarged elevation view of a display device of one embodiment of the present invention.

Referring now to FIG. 3, an embodiment of the present invention is illustrated where an offer display 58 is displayed to a player. In this illustrative embodiment, the offer display 58 represents a stock portfolio having at least two stocks in the portfolio. It should be appreciated that the offer display may represent any suitable type of display that includes multiple offer and acceptance components. The offer display 58 includes a plurality of offers 60*a* to 60*i*. In this embodiment, each offer is designated with a time of day such as 9:00, 10:00 and so forth. It should be appreciated that an offer may be designated or associated with any suitable type of designation desired by the game implementer.

The offers 60*a* to 60*i*, respectively, include a plurality of offer components 62*a* to 62*d*, 64*a* to 64*d*, 66*a* to 66*d*, 68*a* to 68*d*, 70*a* to 70*d*, 72*a* to 72*d*, 74*a* to 74*d*, 76*a* to 76*d* and 78*a* to 78*d*. Each offer component includes two sub-components. It should be appreciated that the offer components could include more than two sub-components. In this illustrative embodiment, the sub-components represent the number of shares and the share price for each stock at a given time. It should be appreciated, however, that the sub-components may represent any desired values or characteristics in a game. In this embodiment, the number of shares is a fixed value and the share price is a variable value. It should be appreciated that the sub-components may be fixed values, variable values or any suitable combination therein which allows the offer components to vary in value. Furthermore, the sub-component values may increase, decrease or stay the same as a player progresses from each offer to offer.

In one embodiment, each of a plurality of different stocks are associated with a plurality of selections. In this embodiment, the player is enabled to pick one or more of the selections and the stocks associated with the player picked selections represent the stocks in the stock portfolio. In another embodiment, a plurality of selections are each associated with a value. In this embodiment, the player is enabled to pick one or more of the selections for each type of stock and the value associated with the player picked selections is the number of shares of that stock the player will initially obtain in the stock portfolio.

In one embodiment, the share price values are randomly determined from a plurality of share price values. For example, in one multi-component offer the share price value for a component may be twenty, in the next multi-component offer, five and then in the next multi-component offer, ten. In one embodiment, the share price values are associated with probabilities of being selected by the processor such that the probability of being selected by the processor associated with one share price value is greater than the probability of being selected associated with another share price value.

In another embodiment, a plurality of share price values are associated with a plurality of selections and the player is enabled to pick one or more selections for each share of stock. In this embodiment, the share price values associated with the player picked selections for each stock are the initial share price value for that stock.

In another embodiment, the share price values are associated with a specific range of share price values. In this embodiment, the share price value is randomly determined from a range of share price values associated with the offer component and may be any value in the range of values. For example, the share price values in a bonus game are determined from a plurality of values from ten to twenty. Therefore, the offer components 62 to 78 may be associated with any share price values in that range. Furthermore, the share price values in the designated range may be associated with probabilities.

In a further embodiment, a plurality of ranges having positive, negative and zero values, are used to determine the share price values, such as the share price values in each offer 60*a* to 60*i*. Each share price value or share price is preferably associated with one range. In one embodiment, the ranges are displayed to the player so that the player can accept or reject one or more components in a particular offer based on the ranges. In another embodiment, the ranges are not displayed to the player. Therefore, in one multi-component offer, a positive value may be applied to the share price. In the next multi-component offer a negative value may be applied to the share price. In the next multi-component offer, a zero value may be applied to the share price where the share price remains unchanged. For example, a share price is associated with the range +2, +1, 0, −1 and −2. In the first offer, the share price is eight. In the next offer the share price is ten because the +2 value was selected from the range. In the next offer, the share price is nine because the −1 value was selected from the range. In another embodiment, each share price is increased or decreased by a percentage of the share current price. For example, a stock valued at $50 may increase 10% rather than increasing $5.

The positive, negative and zero values are preferably associated with probabilities such that the probability of one of the positive, negative or zero values being selected from a given range is greater than another of the positive, negative or zero values being selected from that range. Furthermore, in one embodiment the average value for each share price is zero or approximately zero, which means that the average value of the positive, negative and zero values that are selected and used to modify each share price in the offers is zero or approximately zero.

Additionally, awards are preferably associated with each accepted component in the offers. In one embodiment, the awards equal the stock value associated with the accepted share prices for each stock. In another embodiment, the awards are independent from the stock values. In this embodiment, the gaming device provides the player a predetermined or random award based on the stock value.

Referring now to FIG. 3, one embodiment of the present invention is illustrated where the offer display 58 displays at least two stocks 80 in each bonus game. The stocks 80 are designated with an identifier such as letters A, B, C and D. The identifier may be any type of identifier desired such as a fictitious stock name. Each stock 80 is associated with a number of shares as indicated in the share displays 82. The shares display 82 displays the number of shares of each stock provided by the gaming device at the start of each bonus game. Once the number of shares is determined, in one embodiment that number remains the same throughout the bonus game. In one embodiment, the number of stock shares is associated with probabilities such that the probability of one number of shares being associated with a stock is greater than the probability of another number of shares being associated with a stock. The number of shares may be randomly determined from a plurality of numbers. In another embodiment, each stock is associated with a range of a number of shares and the number of shares for a particular stock is randomly selected from that range.

A plurality of component acceptors 84 are associated with each stock. Alternatively, the gaming device may include component rejectors (not shown) which enables a player to reject a particular component in an offer. It should be appreciated that the gaming device may include both component acceptors and component rejectors in a game. The component acceptors 84 enable a player to choose a particular offer component 62 to 78 from an offer 60*a* to 60*i*. The component acceptors 84 in this illustrative embodiment are designated with the word "SELL" as shown in FIG. 3. It should be appreciated, however, that any phrase, term, or symbol may be used to designate the selections 84. The component acceptors 84 may be buttons, touch-screens or any other form of player selectable devices or mechanism. When a player desires to sell a stock and accept the offer price for that stock, the player presses or selects the component acceptor 84 associated with that stock. Choosing a component acceptor 84 associated with a stock (i.e., accepting a component in an offer), causes the gaming device to provide a value for that stock. The value of a stock equals the offer value multiplied by the number of shares 82 for the stock. In this embodiment, once the gaming device calculates the value for a stock, the value is displayed in the corresponding value or total value display 86*a*, 86*b*, 86*c* or 86*d*. Alternatively, in another embodiment, the gaming device displays the value of the stock throughout the game regardless of whether the component is accepted or not. This embodiment enables the player to make decisions based on the value they will receive if they accept the stock price in a particular offer. It should be appreciated that the value may be displayed at any point in a game as desired.

In one embodiment, the player presses or touches an offer requestor such as the continue button 96. The offer requestor communicates with the processor which generates or displays the next offer to the player when the player presses or activates the offer requester. In another embodiment, the processor generates and displays the next offer automatically after a predetermined amount of time.

The offer display 58 includes a portfolio value display 88, which displays the total value of the stocks that the player sold during the bonus game. The portfolio value display 88 updates the total value indicated by the display 88 each time the player sells a stock. When the player has viewed all of the offers displayed on the offer display 58, the bonus game ends and the player receives the total value indicated by the portfolio value display 88 as the player's award for the bonus game.

Referring now to FIGS. 4A to 4I, an example of the embodiment of the present invention is illustrated where the offer display 58 presents nine multi-component offers 60*a* to 60*i*. The gaming device 10 enables a player to accept (or reject) components from each offer. The player's goal is to accumulate the highest total value possible in the bonus game.

Figure 4A:
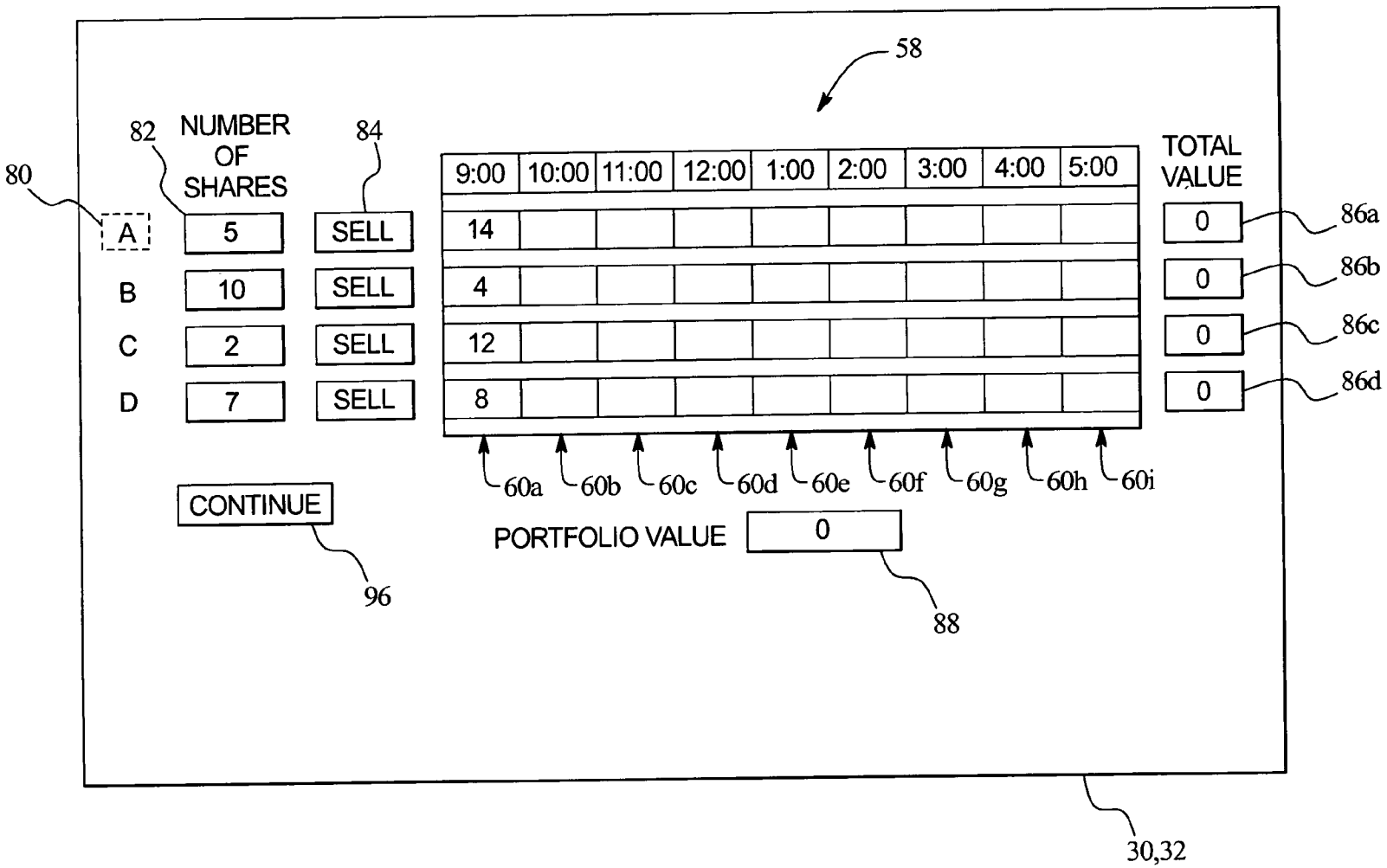
FIGS. 4A to 4I are enlarged elevation views of a display device of one embodiment of the present invention illustrating an example of the bonus game.

Referring to FIG. 4A, the multi-component offers 60*a* to 601 are designated with times 9:00, 10:00, 11:00, 12:00, 1:00, 2:00, 3:00, 4:00 and 5:00, respectively. Each multi-component offer includes four components 62*a* to 62*d* through 78*a* to 78*d* (FIG. 3). The components each represent a stock price for a particular stock at a specific time or offer. In the embodiment where all of the prices or the variable components are determined at the beginning of the game, the stock prices are masked at the beginning of the bonus game and are revealed during each offer. Alternatively, the processor of the gaming device may randomly determine the variable components as the game progresses. The player's goal is to obtain the best possible stock price for each stock in the bonus game.

At the beginning of the bonus game, the processor 38 determines the number of shares 82*a*, 82*b*, 82*c* and 82*d* for each stock 80*a*, 80*b*, 80*c* and 80*d*, respectively. The number of shares 82*a* to 82*d* may be randomly determined or a predetermined value for each stock. In this example, the number of shares for stock A is five, stock B is ten, stock C is two and stock D is seven. The number of shares 82*a* to 82*d* remains fixed or unchanged during the bonus game.

The gaming device displays the first multi-component offer, which is at 9:00, to the player. The offer display 58 reveals a stock price of fourteen for stock A. The stock price fourteen multiplied by the number of shares for that stock, five, equals the total value, seventy, of Stock A in the first offer 60*a*. The price of stock B is four, stock C is twelve and stock D is eight. Similarly, the stock prices for stocks B, C and D, multiplied by the number of shares 82 for each of those stocks, equals the total values for each stock at that offer or time. Since the stock prices are masked before being revealed in each offer, the player must decide whether a particular stock price is going to go up or down and then decide whether to sell or keep a stock according to that decision. Estimating whether a stock will increase or decrease in price or when to buy and sell a stock provides excitement and enjoyment to players.

In another embodiment, the player is provided the option of trading one or more stocks for an equal value of another stock. In another embodiment, the player is provided the option of trading one or more stocks for a lesser value of another stock. In another embodiment, the player is provided the option of trading one or more stocks for a greater value of another stock. In these embodiment, if the player thinks that one stock will perform better than another currently held stock, the player may decide to trade the currently held stock for one or more shares of the other stock.

In FIG. 4A, the player decides not to sell any of the stocks 80*a* to 80*b* during the first offer. By not selling any stocks in the first offer, the player takes a risk and hopes that the stock prices will increase in future offers. The player presses or touches the offer requestor or the continue button 96 to generate and display the next offer.

Figure 4B:
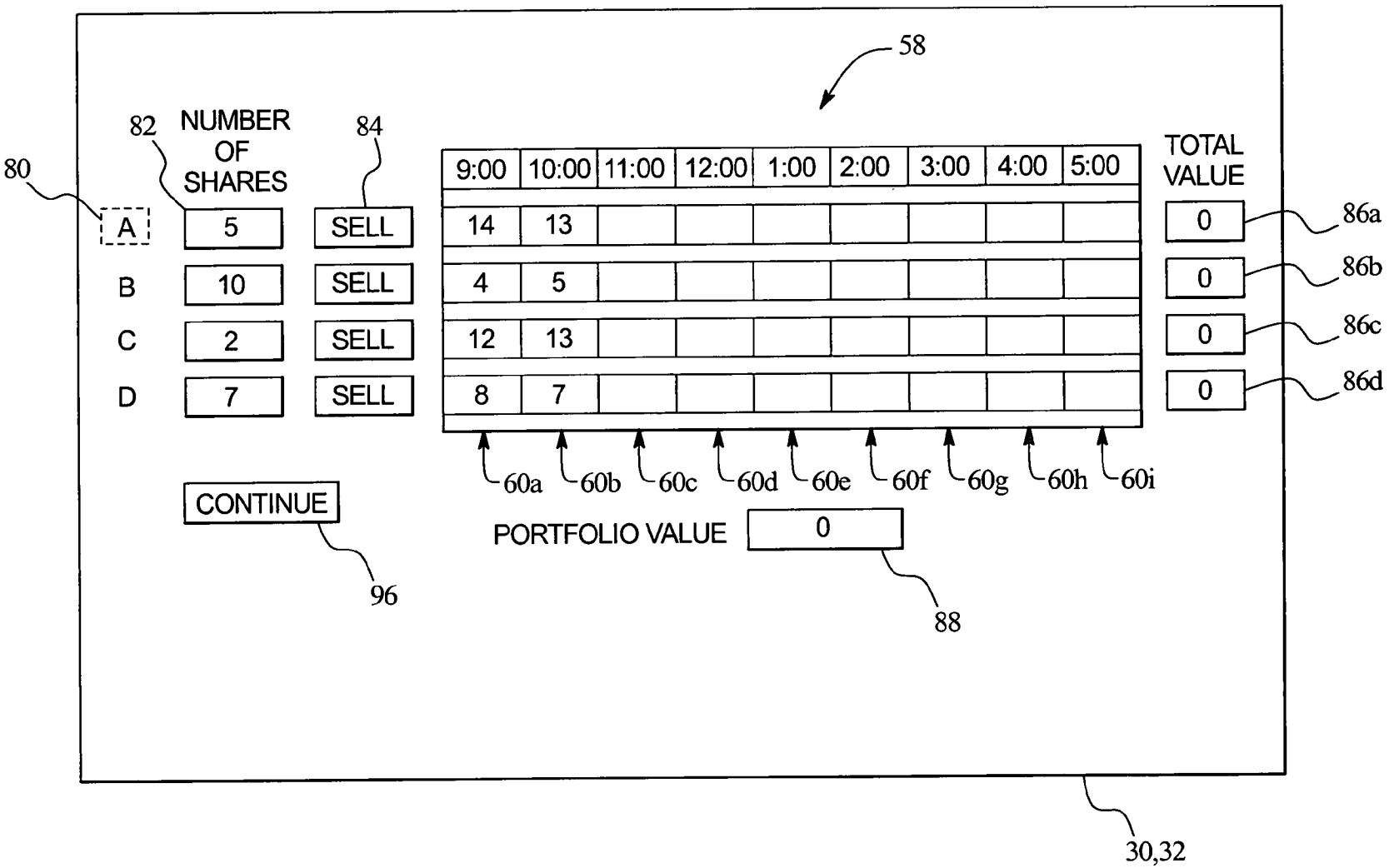

Referring to FIG. 4B, a second multi-component offer 60*b* is presented to the player. Stock prices of thirteen for stock A, five for stock B, thirteen for stock C and seven for stock D are revealed to the player. The stock prices for stocks A and D decreased from the first offer 60*a* to the second offer 60*b*, while the stock prices for stocks B and C increased. The player must now analyze the stock prices and the total values for each stock to determine whether the player should accept a component of the offer and sell a stock or reject one or more components of the offer and hope that the stock prices and values of the stocks increase in subsequent offers. In FIG. 4B, the player decides not to sell any stocks based on the second offer 60*b*. The player presses or touches the offer requestor or continue button 96 to generate and display the next offer.

Figure 4C:
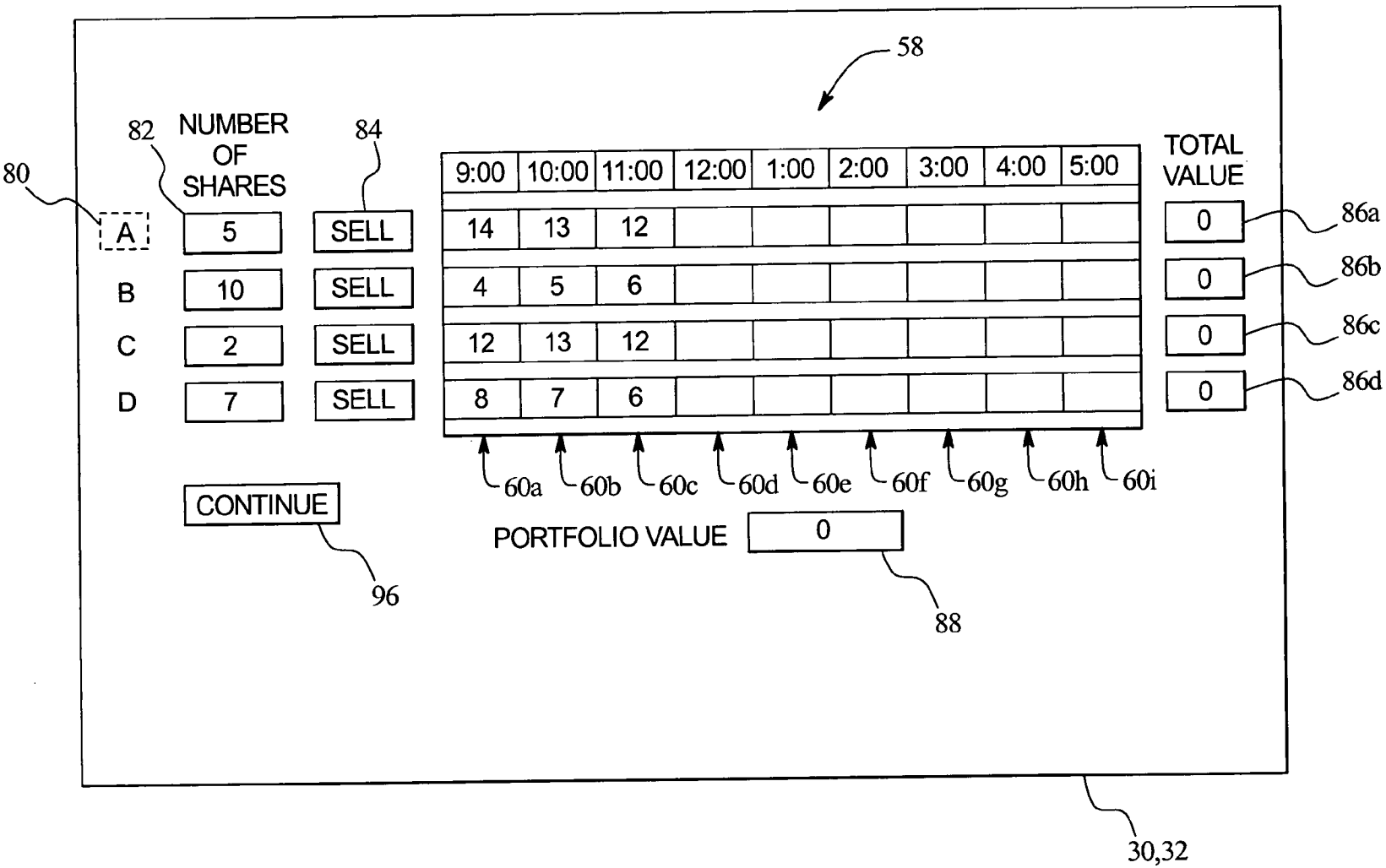

Referring now to FIG. 4C, the offer display 58 displays a third multi-component offer 60*c* to the player. The components in the third offer reveal the stock prices for stocks A to D. In this offer, the stock price of stock A is twelve, stock B is six, stock C is twelve and stock D is six. Three of the four stocks A, C and D, decreased in value because the stock price for these stocks decreased. Because this is the third offer in the bonus game, the player has several stock prices to analyze for each stock based on the three offers. The player will try to determine whether a stock price is likely to increase or decrease in the next offer and then sell or keep a stock based on this determination. In FIG. 4C, the player decides to reject all of the components in the third offer 60*c* and not sell any of the stocks. The player is hoping that the stock prices will increase in subsequent offers. The player presses or touches the offer requestor or the continue button 96 to generate and display the next offer.

Figure 4D:
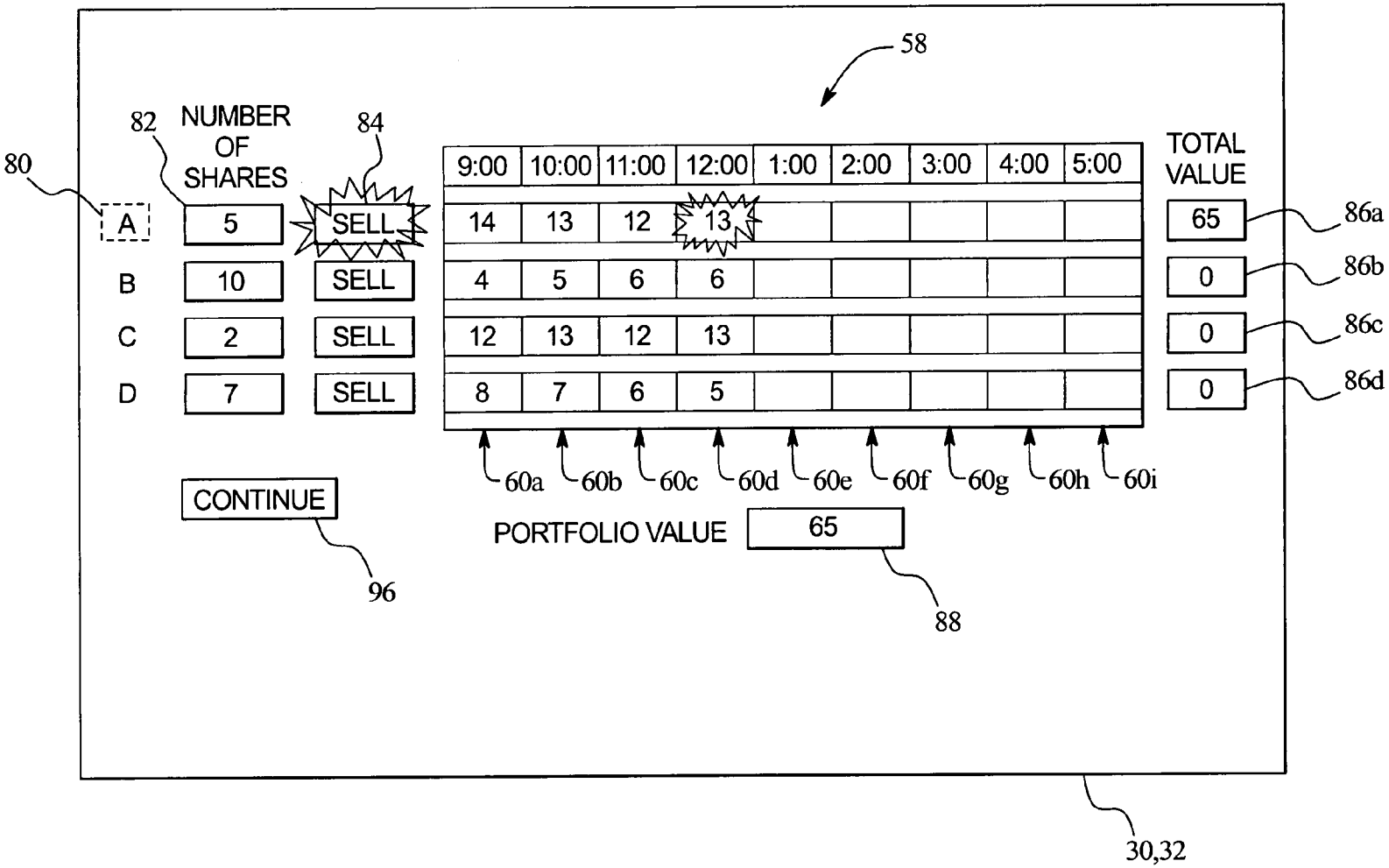

Referring now to FIG. 4D, the fourth multi-component offer 60*d* reveals stock prices for stocks 80*a* to 80*d*. The stock price for stock A is thirteen, stock B is six, stock C is thirteen and stock D is five. The stock prices for stocks A and C increased while the stock price for stock D decreased and the stock price for stock B remained unchanged. The player decides to accept the offer for stock A or sell stock A at the stock price of thirteen provided in offer 60*d*. The player presses the "SELL" button 84 associated with stock A to sell that stock. The total value of stock A in offer 60*d* is the stock price, thirteen, multiplied by the number of shares of stock A, five, which gives a total value of sixty-five. The total value, sixty-five, is indicated in total value display 86*a*, which corresponds to stock A. Furthermore, the portfolio value equals the summation of the total values of the four stocks after the stocks have been sold. Thus, the portfolio value 88 equals the total value of stock A, which is sixty-five. The player presses or touches the offer requestor or the continue button 96 to generate and display the next offer.

Figure 4E:
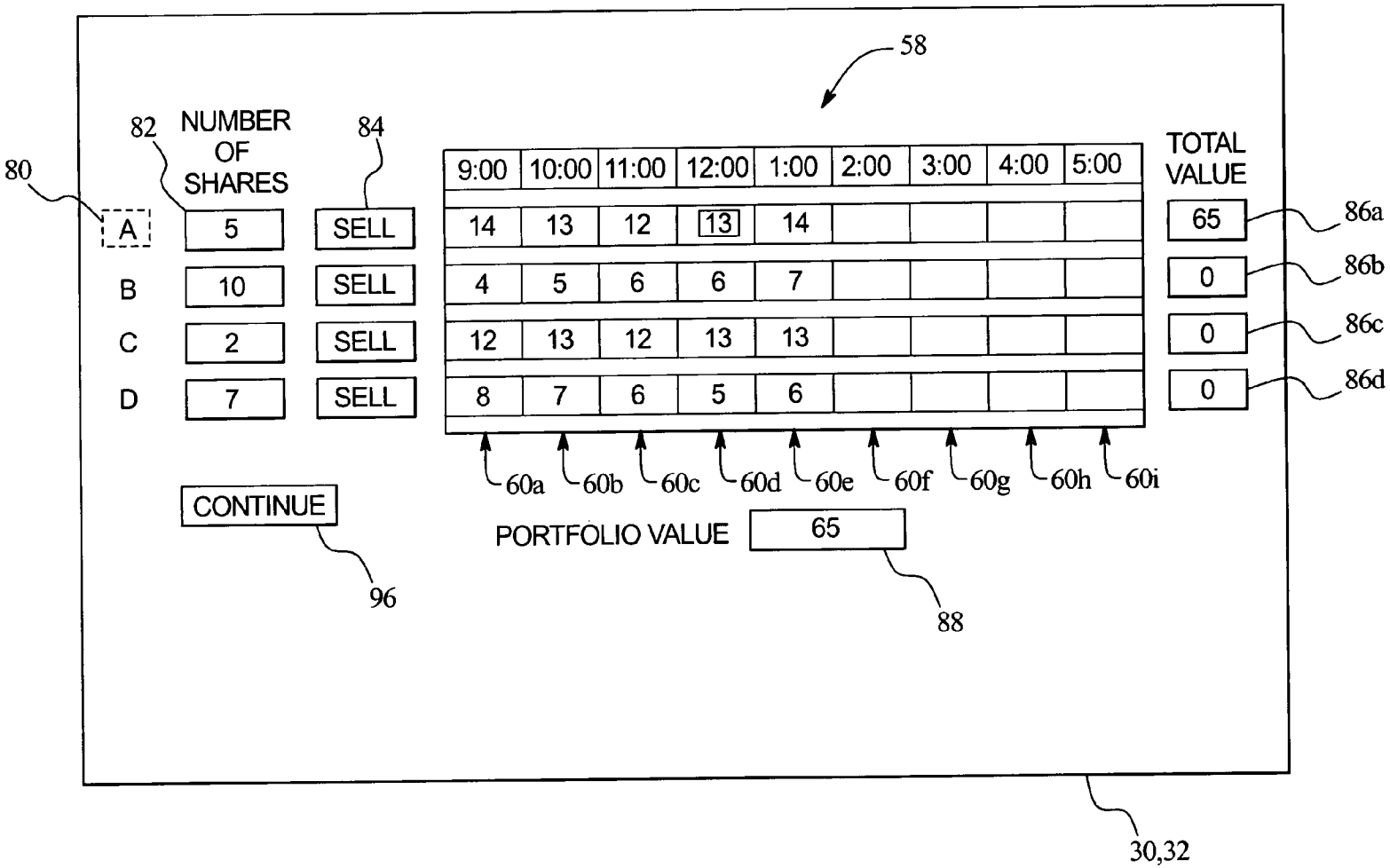

Referring now to FIG. 4E, a fifth multi-component offer 60*e* is presented to the player. Offer 60*e* reveals stock prices of fourteen for stock A, seven for stock B, thirteen for stock C and six for stock D. It should be noted that even though stock A has been sold, offer display 58 continues to display stock prices for stock A so that the player may see whether the player made the correct decision to sell the stock. It should also be appreciated that when a stock is sold, the offer display may not continue to display the stock prices for that stock. Stocks B and C increased in price from the previous offer and the stock price for stock C remained the same. The player must decide whether to accept any of the offer components in offer 60*e* or wait to see what subsequent offers reveal. In FIG. 4E, the player decides to reject all of the components in offer 60*e*. Thus, the portfolio value 88 remains at sixty-five. The player presses or touches the offer requester or the continue button 96 to generate and display the next offer.

Figure 4F:
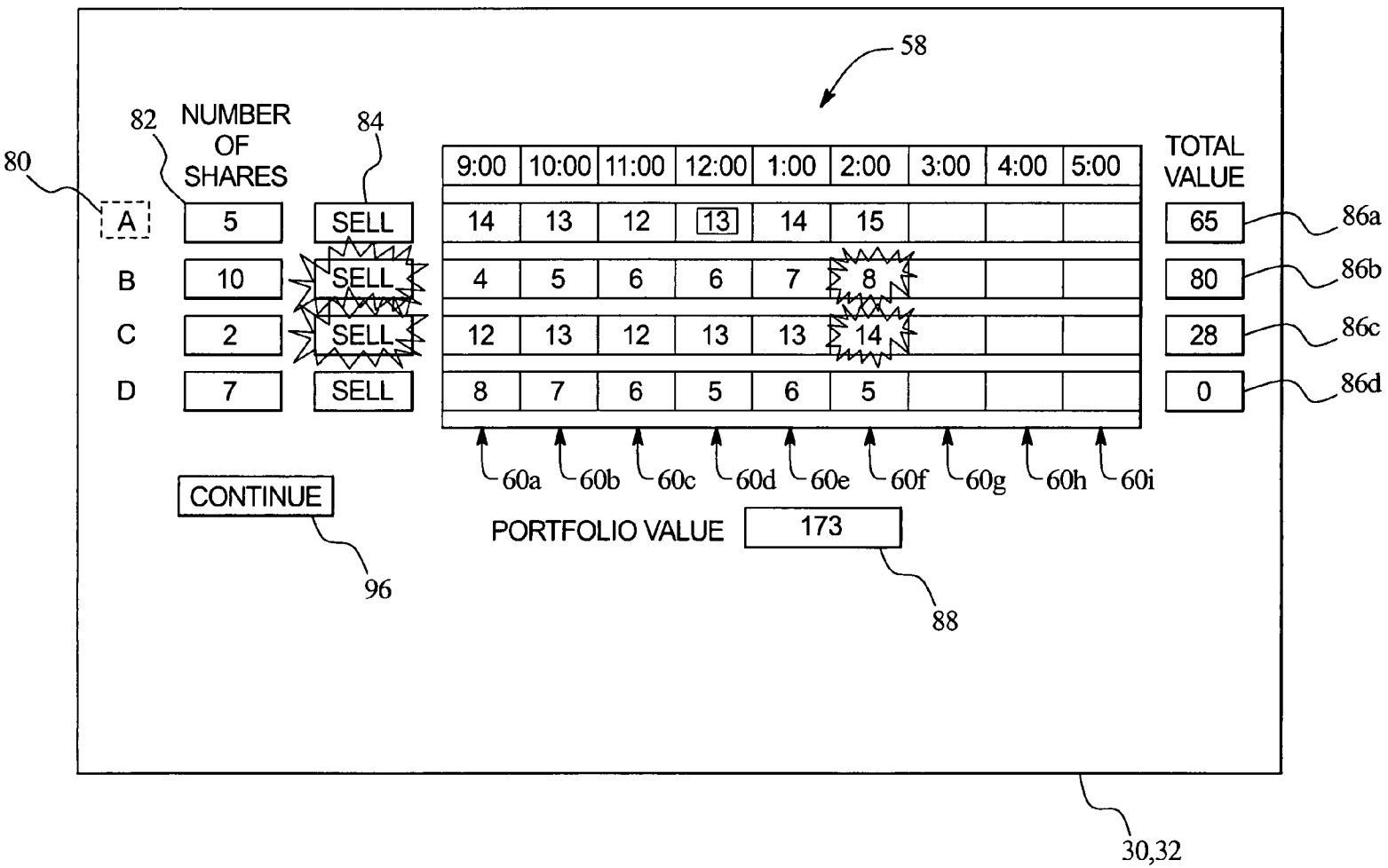

Referring now to FIG. 4F, the sixth multi-component offer 60*f* corresponding to a time of 2:00, includes offer components 72*a* to 72*d*. The offer components reveal stock prices of fifteen, eight, fourteen and five for stocks A, B, C and D, respectively. The stock price of stock D has decreased to five which is down one from the previous offer. However, stocks B and C increased from the previous offer. The stock prices for stocks B and C are eight and fourteen, respectively. These stock prices are the highest stock prices for these stocks. Because there are only three possible offers remaining for each stock, the player decides to sell both stocks B and C while the stock prices are high. The player presses the "SELL" button 84 corresponding to stocks B and C to accept the stock prices offered in offer 60*f*. The total values of stocks B and C are calculated by multiplying the accepted stock price by the number of shares for each stock. In this example, the total values for stocks B and C are eighty and twenty-eight, respectively. The total values from the sale of stocks B and C are added to the portfolio value 88. The portfolio value is one hundred seventy-three after the sale of stocks B and C. The player presses or touches the offer requestor or the continue button 96 to generate and display the next offer.

Figure 4G:
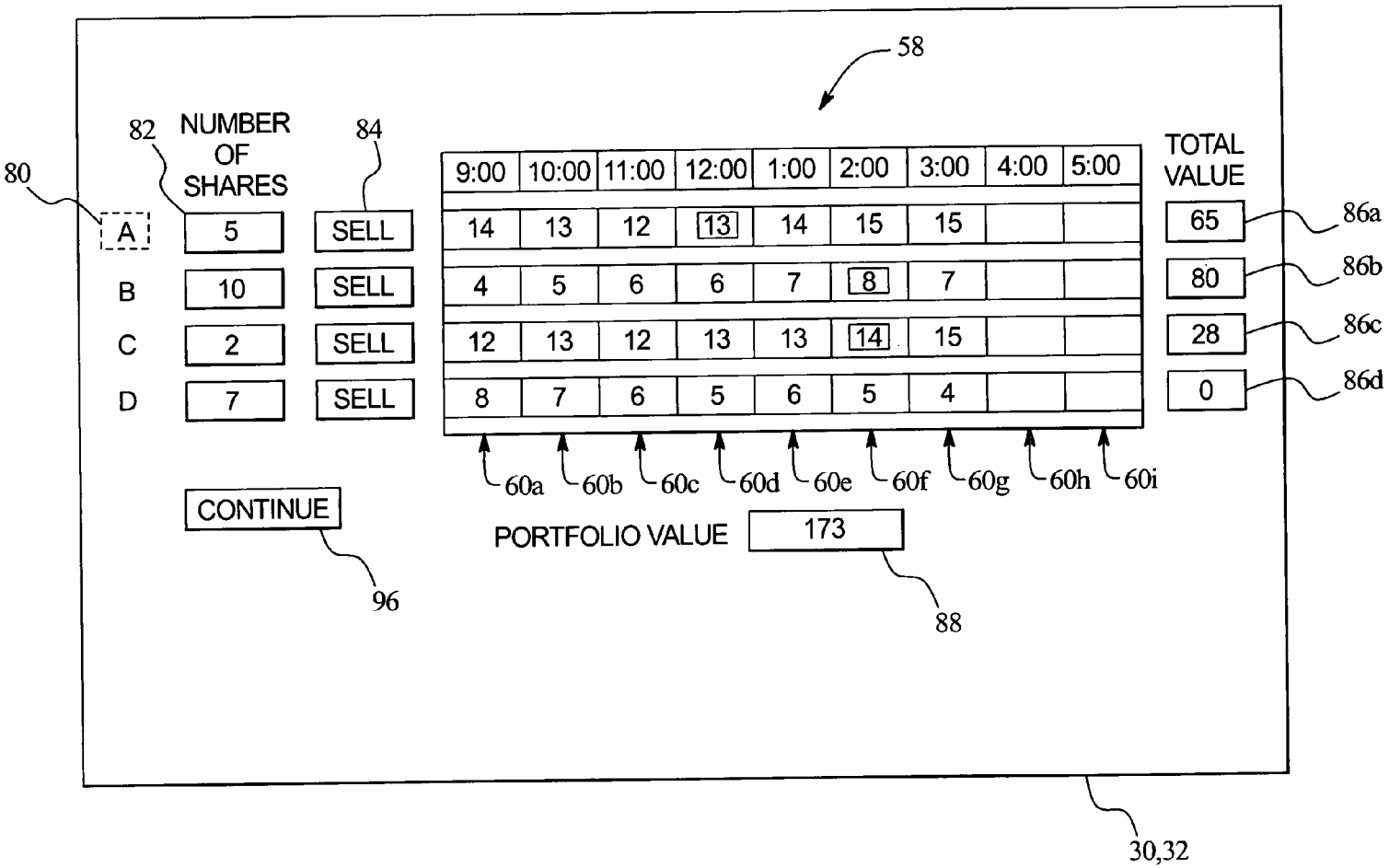

Referring now to FIG. 4G, the seventh multi-component offer in the bonus game reveals stock prices of fifteen, seven, fifteen and four for stocks A, B, C and D, respectively. The player now knows that the player sold stock A and C too early in offers 60*d* and 60*f*, because the stock price for stock A and C has increased to fifteen for both stocks in offer 60*g*. Furthermore, the player seems to have made a good decision to sell stock B since it decreased after the player sold stock B in offer 60*f*. In offer 60*g*, the stock price of stock D is at its lowest stock price of four. Therefore, the player decides to wait and see if stock D's price increases in subsequent offers. The player's portfolio value remains unchanged as indicated by portfolio display 88 because the player did not sell any stocks in offer 60*g*. The player presses or touches the offer acceptor or the continue button 96 to generate and display the next offer.

Figure 4H:
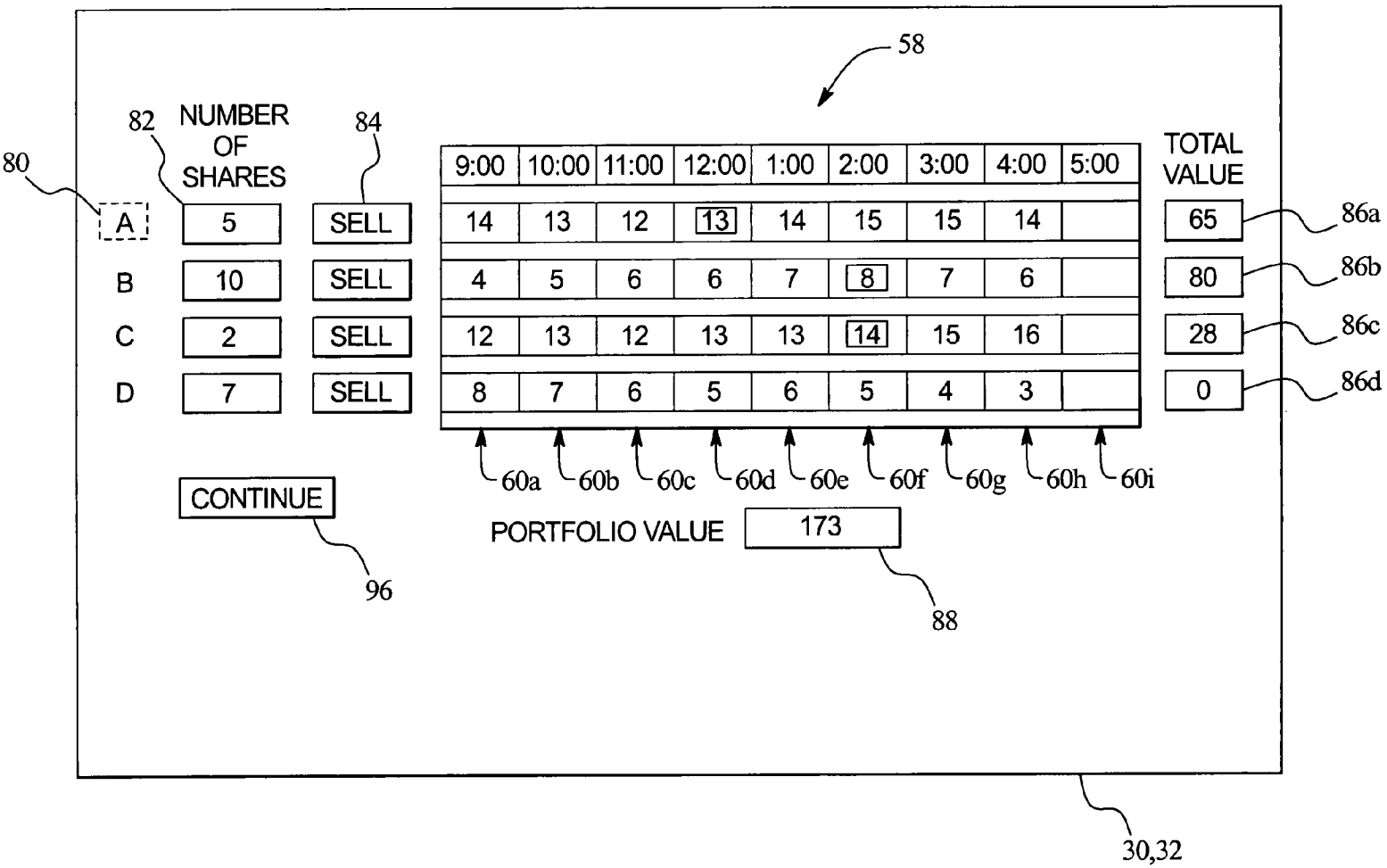

Referring now to FIG. 4H, the offer display 58 provides another multi-component offer to the player. The eighth offer 60*h*, which corresponds to a time of 4:00, reveals stock prices of fourteen, six, sixteen and three for stocks A, B, C and D, respectively. The price of stock A is at fourteen which is only one dollar above the sale price of thirteen in offer 60*d*. The player seems to have made a good decision to sell stock A in offer 60*d*. Similarly, the player sold stock B at a price of eight, which is two dollars higher than the stock price in offer 60*h*. Therefore, the player seems to have made a good sale regarding stock B, too. However, the player sold stock C too early because stock C increased to sixteen in offer 60*h*, which is two dollars higher than the sale price of fourteen in offer 60*f*. The stock price of stock D continues to decrease and the player must decide whether to keep stock D and hope it will increase in the final offer, or sell stock D in offer 60*h*. The player decides to wait and see what the final offer will be for stock D in offer 60*i*. The portfolio value 88 remains at one hundred seventy-three. The player presses or touches the offer requester or the continue button 96 to generate and display the next offer.

Figure 4I:
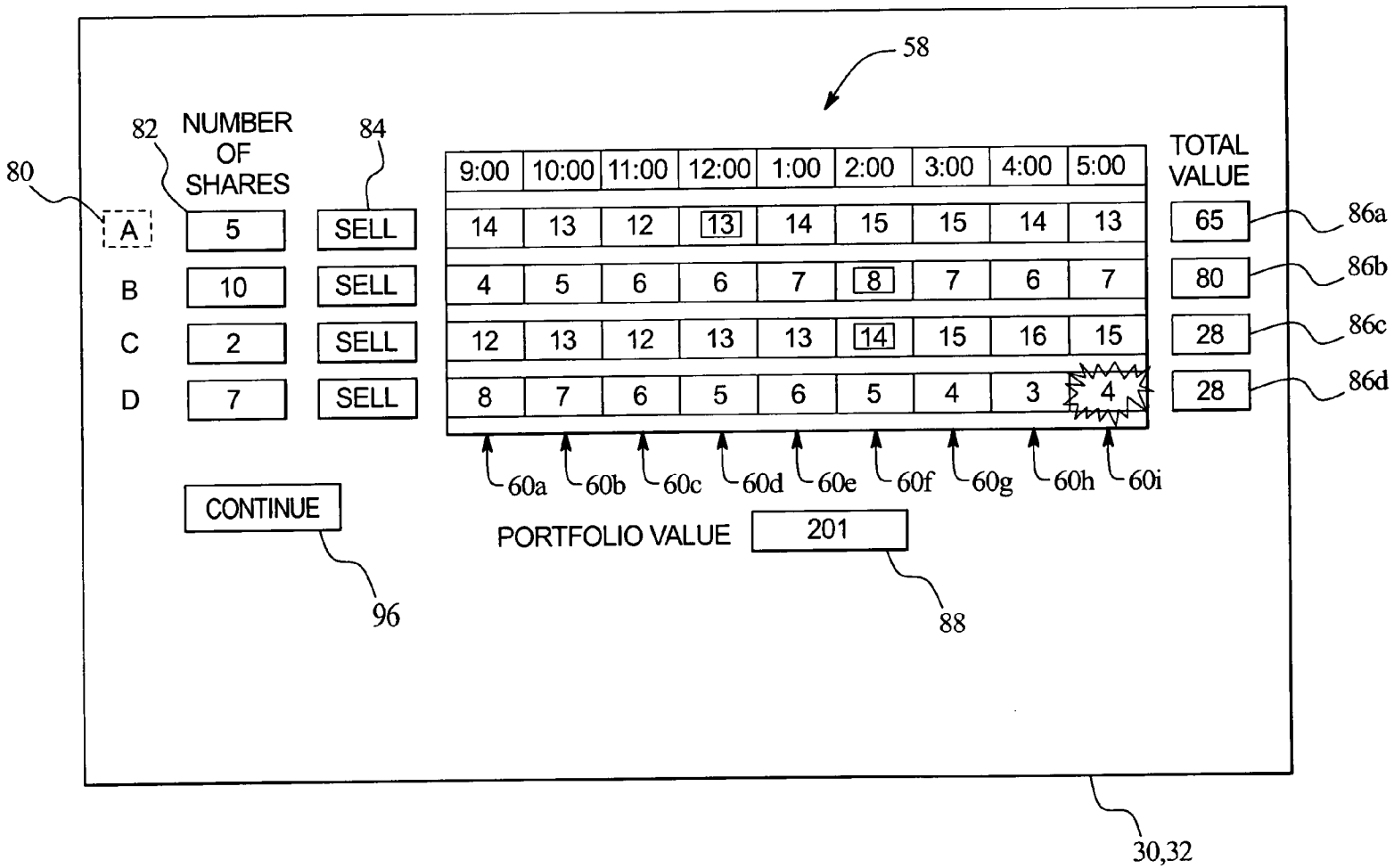

Referring now to FIG. 4I, the gaming device presents the final multi-component offer 60*l* in the bonus game. Any stocks that are not sold by the final offer of a bonus game are automatically accepted and sold by the gaming device. In FIG. 4I, the gaming device automatically sells stock D for a stock price of four in offer 60*i*. Since there are no multi-component offers remaining in the bonus game, the player has no choice but to sell any remaining stocks to obtain value for the stocks. Therefore, in this embodiment the gaming device sells the stock for the player since the player would sell the stock anyway. It should be appreciated that the stock could also be sold by the player and not the gaming device, by pressing or touching the corresponding "SELL" button 84. The total value for stock D as indicated by the total value display 86*d*, is twenty-eight, which equals the stock price of four multiplied by the seven shares of stock D. The total value is added to the portfolio value 88 to obtain a final portfolio value of two hundred one. The player receives the portfolio value as the award for completing the bonus game. The portfolio value may be provided to the player as credits, free spins, free games or any other type of award desired by the game implementer. After the player reaches the final offer in the bonus game, the game ends. The game may also end if the player sold all of the stocks in a bonus game before the final offer is presented to the player. It should be appreciated that the award may equal the total value or be based on the total value. For example, the award may be based on different values where a higher total value provides a larger corresponding award.

The bonus game of the present invention provides excitement and enjoyment to players because of the decisions and risk included in selling the stocks displayed in the offer display 58. The player must try to decide when to sell a particular stock or stocks based on each multi-component offer that is presented to the player. The risk of selling a stock too early or too late causes a player to become deeply involved in each aspect of the bonus game as well as heighten the player's excitement level.

For example in FIG. 4I, the player sold four stocks A, B, C and D. The player sold stock A at a price of thirteen in offer 60*d*. The stock price, however, increased to a high of fifteen and therefore, the player sold stock A too early. The player sold stock B for a price of eight in offer 60*f*. This sale was a good decision by the player because stock B ended up being sold at it highest stock price of eight. The player sold stock C for fourteen in offer 60*f*. Although fourteen was not a low price for stock C, the highest price ended up being sixteen in offer 60*h*. Therefore, the player sold stock C too early. The player sold stock D too late. Stock D started the bonus game at eight in offer 60*a* and then decreased continuously to four in offer 60*i*. Unfortunately, the player took a risk and waited to see if the stock price of stock D would increase in later offers. This example illustrates the decisions a player must make during the bonus game of the present invention and the corresponding risks associated with those decisions.

In an alternative embodiment, the range of values that each stock is increased or decreased by when the player decides to keep the stock is based on the stocks current value when the player decided to keep the stock. In one embodiment, the range of values that a high valued stock can increase or decrease is greater than the range of values that a low valued stock can increase or decrease. For example, for a stock valued at under $10, the stock may increase or decrease by up to $2 for the next adjustment period if the player decides to keep the stock. On the other hand, for a stock valued at over $50, the stock may increase or decrease by up to $10 for the next adjustment period if the player decides to keep the stock. In one embodiment, the different ranges of possible stock value changes are displayed to the player. In another embodiment, the different ranges of possible stock value changes are not displayed to the player.

In another embodiment, the range of values that each stock is increased or decreased by when the player decides to keep the stock is based on the type of stock, such as a growth stock or a value stock. In this embodiment, growth or speculative stocks may have a greater range of value changes (i.e., a high volatility) than a value or conservative stock (i.e., a low volatility). It should be appreciated that this embodiment, the player is enabled to select their own volatility during play of the bonus game.

Figure 5A:
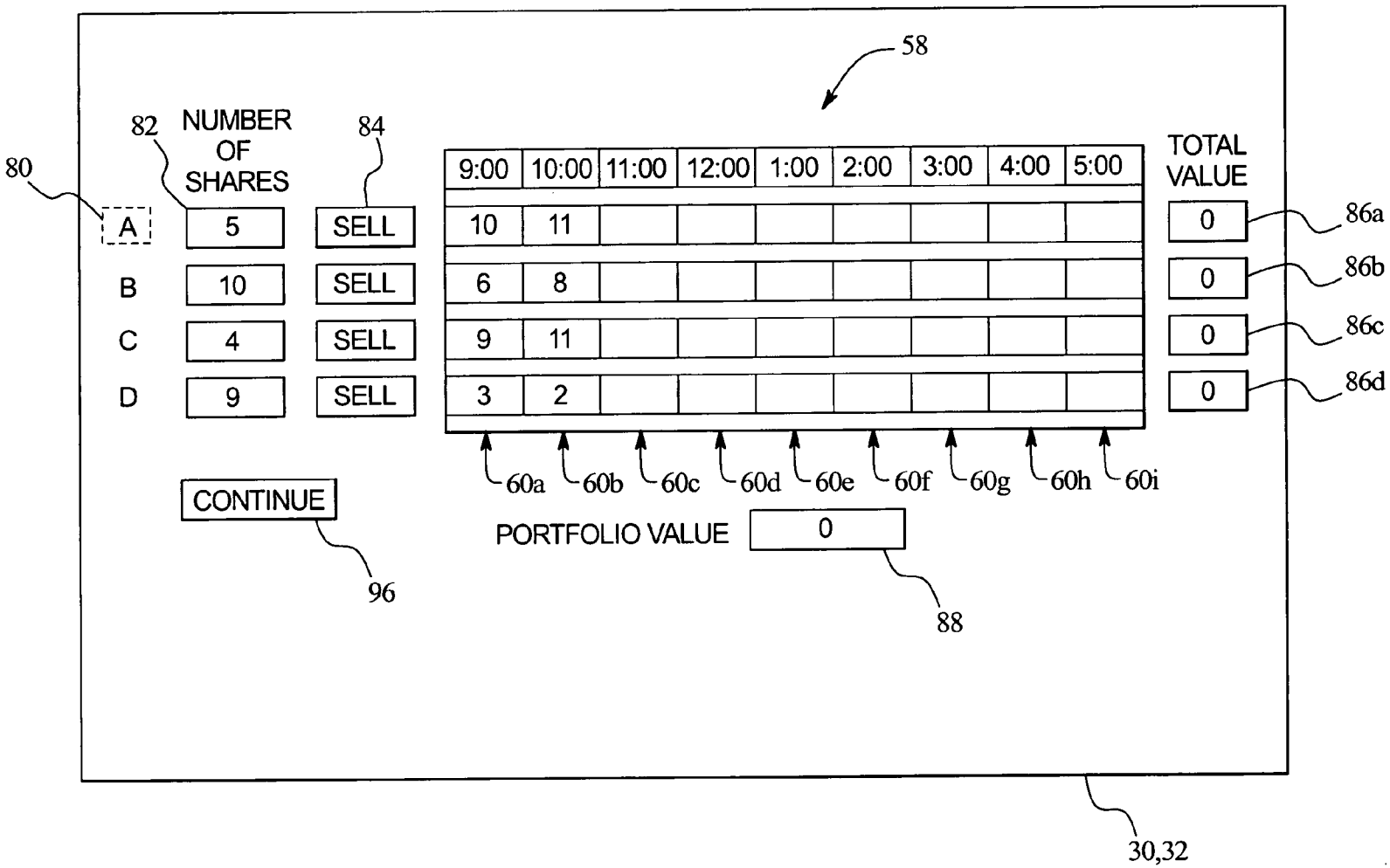
FIGS. 5A and 5B are enlarged elevation views of another embodiment of the present invention where a stock splits during the bonus game.
Figure 5B:
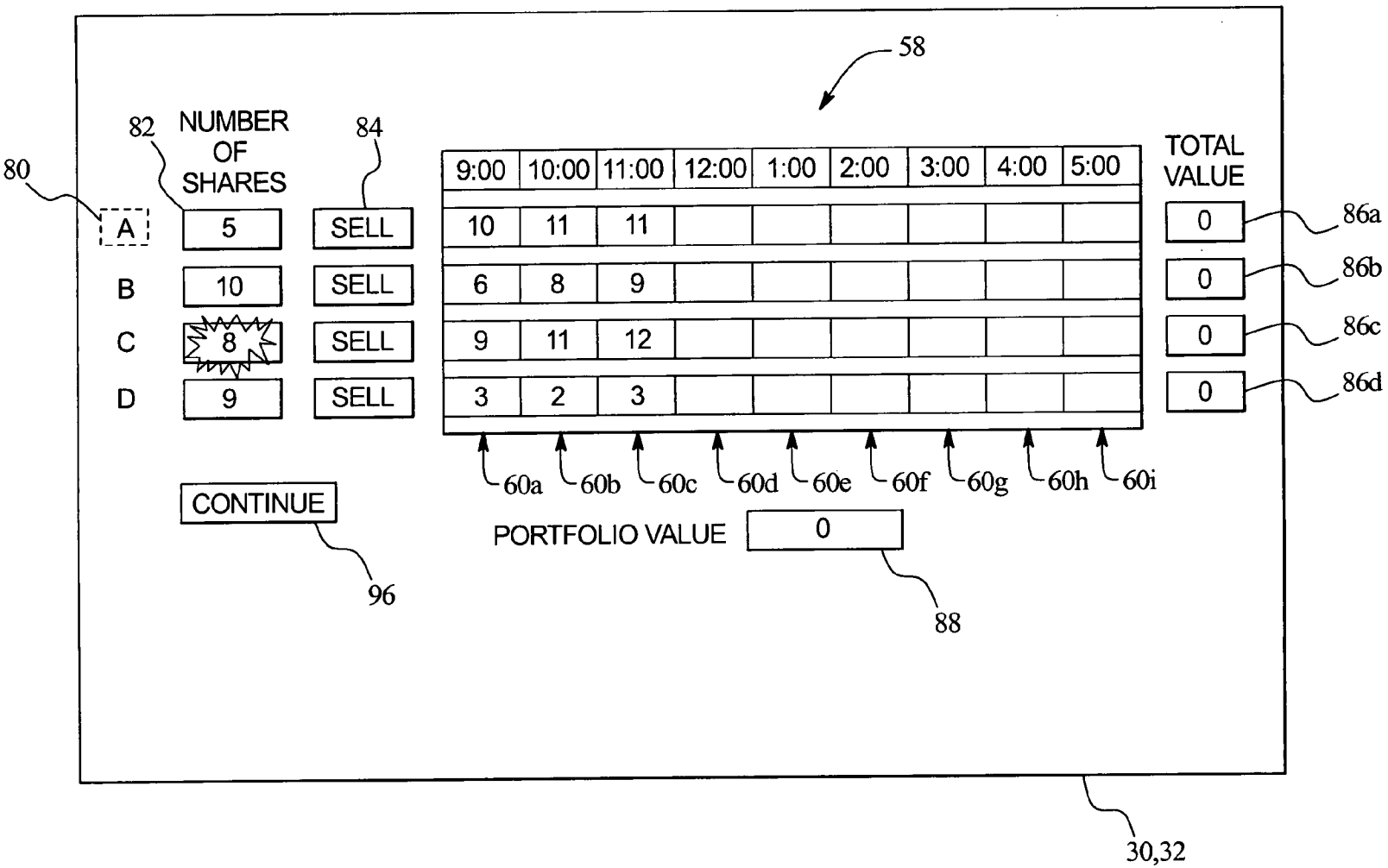

Referring now to FIGS. 5A and 5B, another embodiment of the present invention is illustrated where the number of shares 82 of a stock split during a bonus game. A stock split changes the number of shares of a stock during a bonus game. The split may increase the shares 82 of a stock such as double or triple the shares, or a split may decrease the number of shares (i.e., a reverse split). Furthermore, the stock split may occur at any point in the game. One or more stocks may split in each offer or in a plurality of offers. In a preferred embodiment, the stock split increases the number of shares of stock. As a result, the stock value or award associated with the stock increases, which increases the player's excitement and enjoyment.

In FIG. 5A, the offer display indicates the number of shares for each stock A, B, C and D in displays 82. Stocks A, B, C and D have five, ten, four and nine shares, respectively. In FIG. 5B, the shares of stock C split prior to the third offer 60*c* in the bonus game. In this example, the shares of stock C increased from four to eight. It should be appreciated that a bonus game may include several stock splits of a single stock, multiple stocks or no stock splits. In this example, the stock split increases the number of shares of stock C and therefore increases the total value of that stock. Additionally, a split may also alter the price.

Figure 6A:
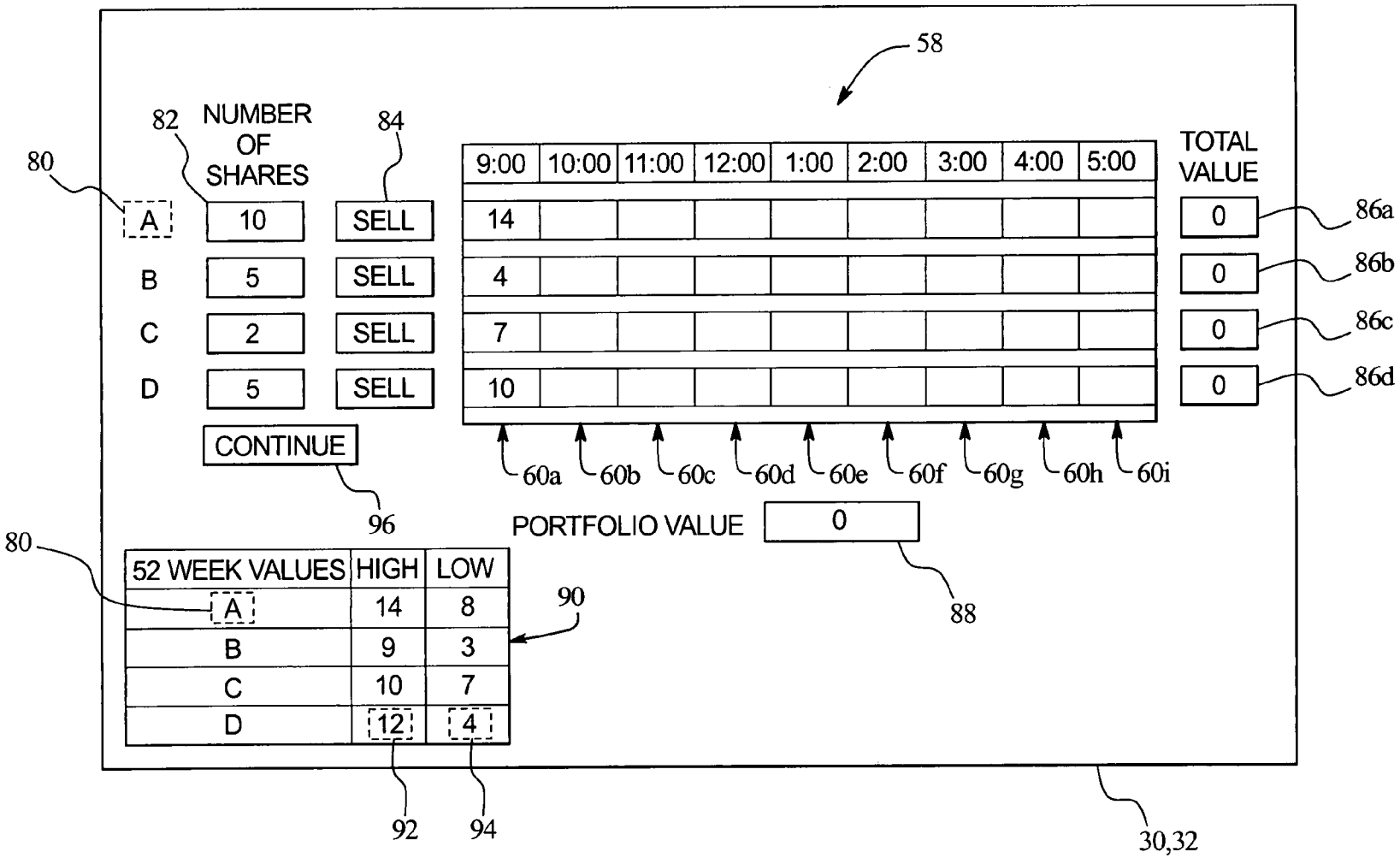
FIGS. 6A and 6B are enlarged elevation views of a further embodiment of the present invention where a fifty-two week value display is included on the main display device.
Figure 6B:
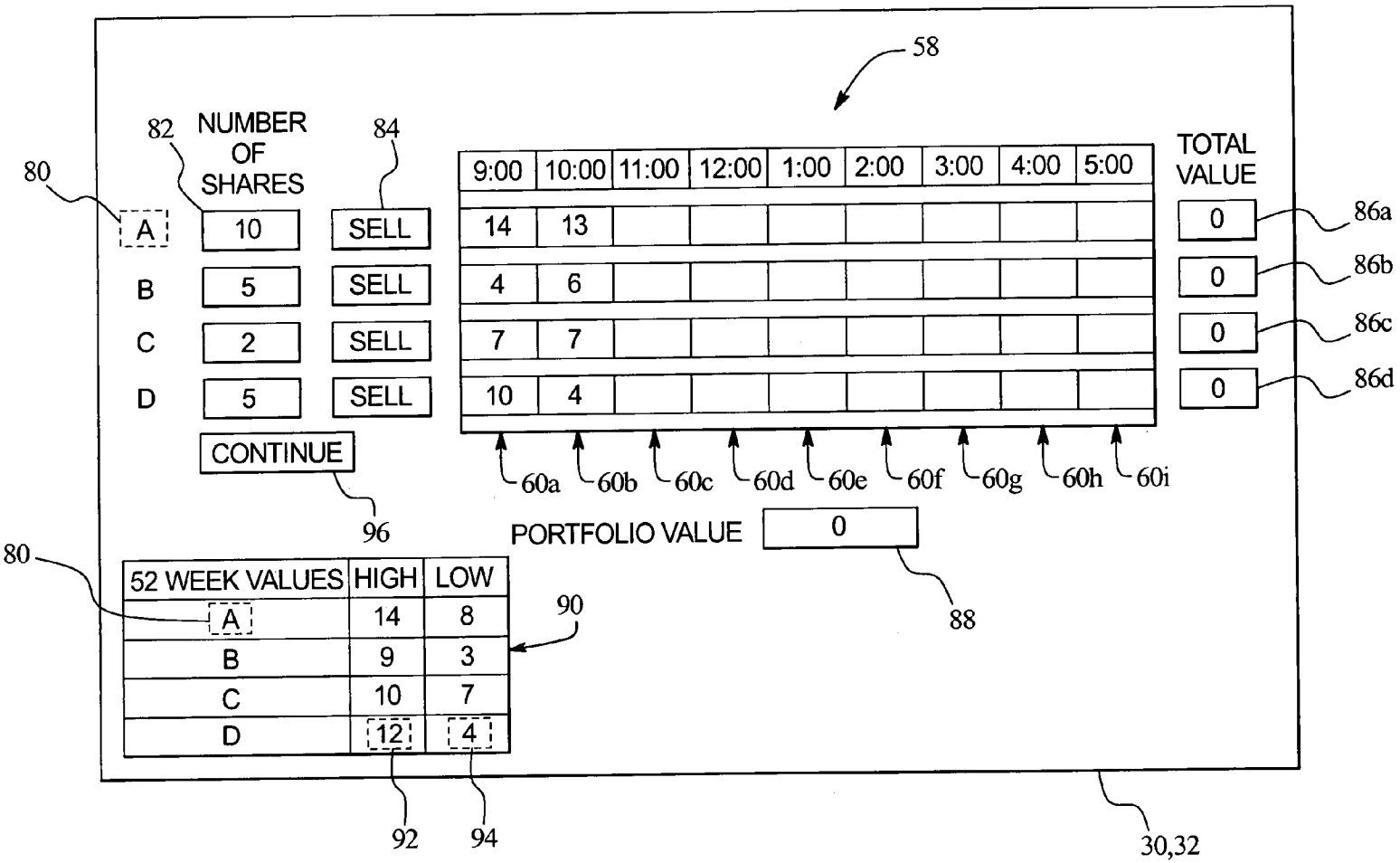

Referring now to FIGS. 6A and 6B, a further embodiment of the present invention is illustrated where a price range is displayed to the player for each stock. In this embodiment, the price range is displayed as a fifty-two week stock price summary table 90 that indicates the highest stock price 92 and the lowest stock price 94 over the fifty-two week period for each stock displayed in the offer display 58. The fifty-two week stock price summary table 90 aides a player in analyzing the trends related to the stock prices for each stock. The information in the summary table 90 enables the player to decide whether a particular stock price offer is a good offer or if the player should wait for a better offer.

For example in FIG. 6A, the multi-component first offer 60*a* in the bonus game, presents a stock price of fourteen for stock A. If the player looks at the stock price summary table 90, the player realizes that fourteen is the highest stock price for stock A over the past fifty-two weeks. Thus, the player should sell stock A since it is unlikely that the price of stock A will exceed fourteen or exceed fourteen by a substantial amount. Similarly, the player may want to sell stock D at the offered price of ten because stock D is near its highest fifty-two week stock price of twelve. The player may choose to keep stocks B and C because both stocks are at or near the lowest fifty-two week stock prices for the fifty-two week period at prices of three and seven, respectively.

Referring to FIG. 6B, the player did not sell any stocks in the first offer 60*a*. The second multi-component offer 60*b* reveals stock prices of thirteen, six, seven and four for stocks A, B, C and D, respectively. The player made poor decisions with respect to stocks A and D because both stocks decreased in value from the previous offer 60*a*. While stock C remained the same, stock B increased by two dollars. Therefore, the player made the correct decision to not sell stock B regarding the information pertaining to stock B in the stock price summary table 90. The fifty-two week stock price summary table 90 enables the player to make better decisions on whether to sell the stocks in offer display 58 and thereby increases the player's involvement and excitement in the bonus game.

In an alternative embodiment of the present invention, one or more multi-component offers each including a plurality of offer components are displayed to a player. Each component includes a first sub-component and a second sub-component. The first sub-component represents an outcome to a question, hint or other prompt that is presented to the player. The first sub-component or outcome, changes in each offer. The second sub-component is a variable value or award which is associated with the first sub-component. The value of the second sub-component changes when the outcome associated with the first sub-component changes in each offer. The player determines whether to accept or reject the components in the offers based on the sub-components associated with each component. If the player accepts a component in an offer, the player receives the value or award associated with that component. The player continues to accept (or reject) components in the offers until all of the components have been accepted or until there are no offers remaining.

In one illustrative embodiment, the first sub-component in each component includes a question, which is presented to the player. The questions may be any suitable question, but preferably, the questions are related to the theme of the game. The gaming device then displays the first sub-component to the player, which is an outcome or answer to each question. Additionally, the second sub-component, which is a value or award associated with the first sub-component, is displayed to the player. The player may independently accept each component based on the answer and associated value for that answer (i.e., the first and second sub-components). If the player accepts any of the components, the player receives the values of the second sub-components associated with the accepted components.

In one embodiment, if the player rejects, or does not accept, any of the answers or outcomes, the gaming device enables the player to enter or select a new answer (i.e., first sub-component) to the question. The value or second sub-component, associated with the player's entered answer is then displayed to the player. The player decides if the player wants to accept or reject that answer based on the value associated with the answer. In another embodiment, the gaming device automatically displays another answer or outcome to the player when the player rejects the first answer. The gaming device continues to enable the player to enter and accept or reject answers in each offer until the player has accepted all of the answers or outcomes for each question, or until there are no offers remaining. At the end of the bonus game, the player receives the total value associated with the accepted answers from the offers.

Figure 7A:
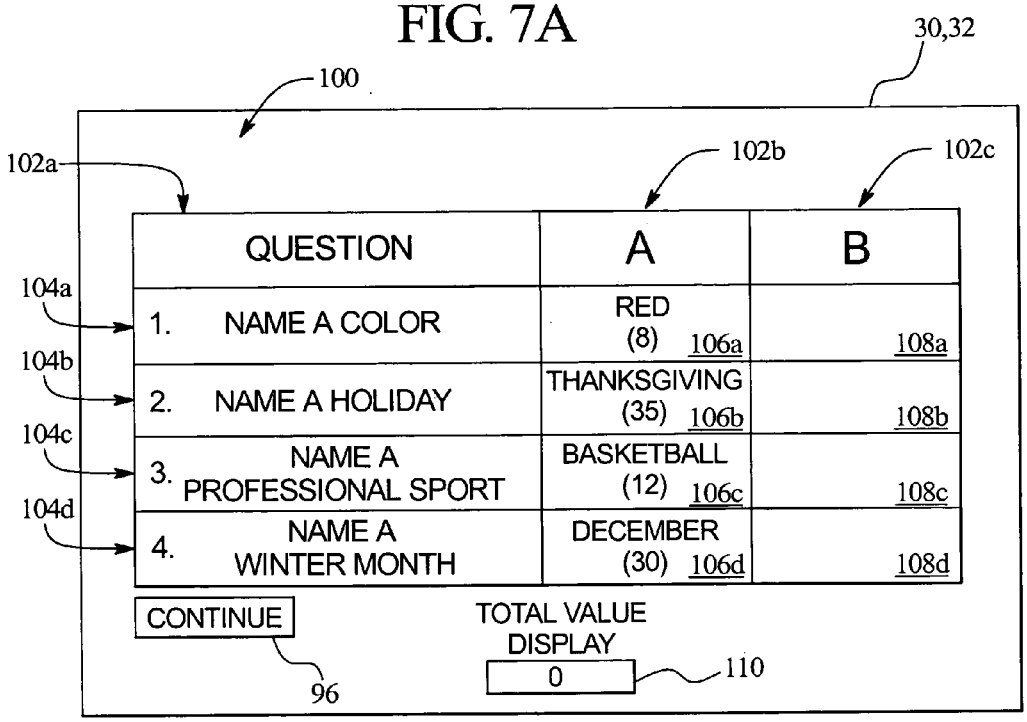
FIGS. 7A, 7B and 7C are enlarged elevation views of another embodiment of the present invention where each offer includes answers to questions displayed to a player.

Referring now to FIG. 7A, the gaming device displays an offer display 100 including two separate offers, offer A in column 102*b* and offer B in column 102*c*. A plurality of questions, as shown in column 102*a*, are displayed to the player. In one embodiment, each question 104*a*, 104*b*, 104*c* and 104*d* is different and has more than one outcome or answer. The offer components 106*a*, 106*b*, 106*c*, 106*d* in column 102*b* represent answers to questions 104*a*, 104*b*, 104*c* and 104*d*, respectfully. Similarly, offer components 108*a*, 108*b*, 108*c* and 108*d* include answers that are entered by the player, if the player does not accept one or more of the answers displayed in column 102*b*. The player enters answers by selecting an answer from a plurality of answers displayed to the player or by using a keyboard (not shown) or other suitable input device. In this example, there are four questions. The first question asks the player to "name a color" as indicated in row 104*a*. The second question asks the player to "name a holiday" as indicated in row 104*b*. The third question asks the player to "name a professional sport" as indicated in row 104*c*. The fourth and final question asks the player to "name a winter month" as indicated in row 104*d*. The first offer A in column 102*b* displays an outcome or answer to each question. The outcome or answer has an associated value, which may be predetermined or randomly determined. The player may accept (or reject) one or more of the answers 106*a*, 106*b*, 106*c* and 106*d*. If the player accepts an answer, the player is provided with the value for that accepted answer. If the player does not accept or reject one or more of the answers the gaming device enables the player to enter or input another answer in the respective offer components 108*a*, 108*b*, 108*c* and 108*d* in column 102*c*. The player's total value is the summation of the accepted components from the plurality of offers. The total value is displayed in the total value display 110.

Figure 7B:
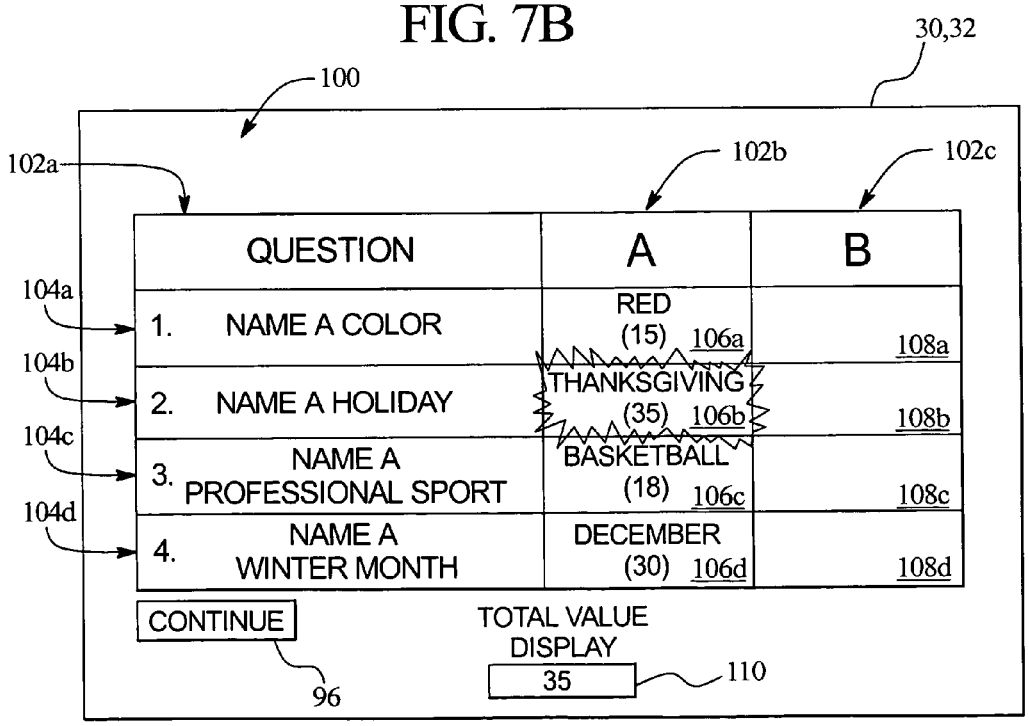

In FIG. 7B, the player reviews the initial offer including the four answers 106*a*, 106*b*, 106*c* and 106*d* in column 102*b*. The player decides to accept answer 106*b* in offer A. Specifically, question 104*b* asks the player to name a holiday. The initial answer provided to the player was "Thanksgiving," which has an associated value of thirty-five. In one embodiment, the value associated with each answer is higher for more likely or typical answers and lower for less likely or less typical answers. Therefore, in this example, the answer "Thanksgiving" may be viewed as a typical or likely answer. However, if the player decides that there may be a more typical or more likely answer such as "Christmas," the player may opt to reject that answer and enter "Christmas" as the answer in column 102*c*. Thus, the game includes some risk to the player in accepting or rejecting particular answers. In this example, the player decides to accept the answer "Thanksgiving" in 106*b* and receive the associated value of thirty-five. This value is transferred and displayed in the total value display 110. The player also decides not to accept or reject the other answers in offer components 106*a*, 106*c* and 106*d* in offer A. Therefore, the player will enter their own answer in offer B for offer components 108*a*, 108*c* and 108*d*. The player presses or touches the offer requester or the continue button 96 to generate and display the next offer.

Figure 7C:
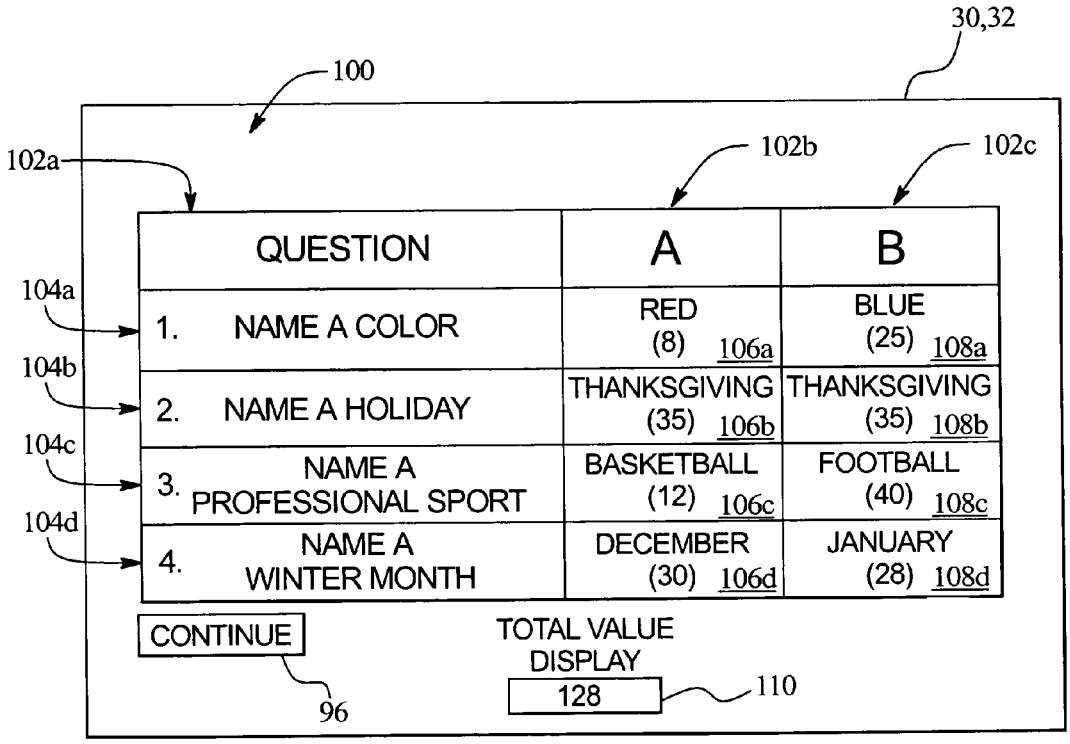

Referring to FIG. 7C, the player enters the answer "blue" in 108*a* as an answer to the question "name a color." The answer "blue" has an associated value of twenty-five, which is greater than the value associated with the previous answer in 106*a*. Thus, the player is rewarded for taking a risk in rejecting the initial answer in 106*a*. The player also enters an answer in offer component 108*c*, which is "football." This answer is a response to the question "name a professional sport" as indicated in 104*c*. The answer "football" has an associated value of forty, which is greater than the initial answer in 106*c*. Thus, the player again is rewarded for taking a risk and rejecting the initial offer in 106*c*. Finally, the player enters an answer in 108*d* which is the month of "January." This answer is a response to the question "name a winter month" as indicated in 104*d*. The answer has an associated value of twenty-eight, which is less than the initial answer "December" in 106*d*. The answer "December" has an associated value of thirty, which is greater than the answer entered by the player in 108*d*. Thus, the player took a risk and the risk did not result in a greater value. The player receives the total or sum of all the accepted answers from offers A and B, which is a total value of one hundred twenty-eight as indicated in total value display 110. The total value is provided to the player at the end of the bonus game.

In an alternative embodiment, the present invention provides a skill game to the player. In this embodiment, the player is provided an offer or offer component. The player may accept the offer or reject the offer and obtain a question. If the player accepts the offer, the game ends. If the player rejects the offer and answers the question correctly, the offer increases. If the player rejects the offer and answers the question incorrectly, the offer decreases. At this point, the player again may accept the offer or reject the offer and be asked another question.

In another embodiment illustrating the present invention employed as a skill game, the player is provided a plurality of groups or categories of questions. The player is provided an initial value in each category along with an initial question relating to each category. For each category, the player can accept or reject the current value. If the player accepts the current value, the current value is provided to the player and the category is closed. If the player rejects the current value, the player inputs an answer to the question associated with that category. If the player's answer is correct, the value for that category increases and the player is provided another question relating to that category. If the player's answer is incorrect, the value for that category decreases and the player is provided another question relating to that category. In one embodiment, the player plays each category simultaneously. In another embodiment, the player plays each category sequentially. As described above, the player may accept the value for that category or risk the value and try to answer the other question correctly. This continues until either the player accepts a value for each category or there are no questions remaining for each pending category. For example, if one category is sports and the player is confident in their knowledge of sports, the player may decide to keep rejecting values in an attempt to answer as many questions correct as possible and thus obtain the greatest value. On the other hand, if another category is a field the player has little or no knowledge about, the player may decided to accept the initial value rather than risk answering a question incorrectly and thus decreasing part of the initial value.

While the present invention is described in connection with what is presently considered to be the preferred embodiments, it should be appreciated that the invention is not limited to the disclosed embodiments and is intended to cover various modifications and equivalent arrangements included within the spirit and scope of the claims. Modifications and variations in the present invention may be made without departing from the novel aspects of the invention as defined in the claims and this application is limited only by the scope of the claims.

The invention is claimed as follows:

1. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) select a multi-component numerical value offer from a plurality of at least three multi-component numerical value offers, each of said plurality of multi-component numerical value offers including a plurality of numerical value components, each of said numerical value components including a plurality of numerical value sub-components, wherein an amount of each numerical value component is based on the numerical value sub-components of said numerical value component;

(b) display the selected multi-component numerical value offer by displaying each of the numerical value components and each of the numerical value sub-components of the selected multi-component numerical value offer;

(c) for each of the plurality of numerical value components of said displayed multi-component numerical value offer, enable a player to independently accept said numerical value component regardless of whether the player accepts any of the other numerical value components;

(d) if the player has accepted a predetermined number of at least two of said numerical value components of said displayed multi-component numerical value offer:

(i) determine a first award based on the amounts of any accepted numerical value components, and (ii) provide the determined first award to the player;

(e) if the selected multi-component numerical value offer is a final multi-component numerical value offer:

(i) determine a second award based on the amounts of any accepted numerical value components, and (ii) provide the determined second award to the player; and (f) if the player has not accepted the predetermined number of at least two of said numerical value components of said displayed multi-component numerical value offer and at least one of the plurality of multi-component numerical value offers remains unselected:

(i) select another multi-component numerical value offer from said plurality of multi-component numerical value offers, and (ii) repeat (b) to (f) at least once.

2. The gaming device of claim 1, wherein each numerical value component includes at least one static numerical value sub-component.

3. The gaming device of claim 1, wherein each numerical value component includes at least one variable numerical value sub-component.

4. The gaming device of claim 3, wherein the plurality of instructions, when executed by the at least one processor, cause the at least one processor to change the variable numerical value sub-component for each multi-component numerical value offer.

5. The gaming device of claim 3, wherein the plurality of instructions, when executed by the at least one processor, cause the at least one processor to change the variable numerical value sub-component for each of a plurality of the multi-component numerical value offers.

6. The gaming device of claim 3, wherein the plurality of instructions, when executed by the at least one processor, cause the at least one processor to change the variable numerical value sub-component for each of a plurality of the multi-component numerical value offers by at least one amount selected from the group consisting of: a predetermined amount, a random amount, an amount in a range of values and an average amount.

7. The gaming device of claim 6, wherein the average amount is approximately zero.

8. The gaming device of claim 6, wherein the average amount is zero.

9. The gaming device of claim 3, wherein the plurality of instructions, when executed by the at least one processor, cause the at least one processor to select the variable value numerical sub-component from a range of values.

10. The gaming device of claim 9, wherein the plurality of instructions, when executed by the at least one processor, cause the at least one processor to associate a probability of being selected with each value in the range of values.

11. The gaming device of claim 10, wherein the plurality of instructions, when executed by the at least one processor, cause the at least one processor to operate with the at least one display device to display the range of values.

12. The gaming device of claim 1, wherein each numerical value sub-component includes at least one static numerical value sub-component and at least one variable numerical value sub-component.

13. The gaming device of claim 12, wherein each of the value components equals the static numerical value sub-component multiplied by the variable numerical value sub-component for said value component.

14. The gaming device of claim 1, wherein the plurality of instructions, when executed by the at least one processor, cause the at least one processor to cause the numerical value components to increase, decrease or remain unchanged for each of a plurality of the multi-component numerical value offers.

15. The gaming device of claim 1, wherein the plurality of instructions, when executed by the at least one processor, cause the at least one processor to change the numerical value components for each of a plurality of the multi-component numerical value offers by at least one amount selected from the group consisting of: a predetermined amount, a random amount, an amount in a range of numerical values and an average amount.

16. The gaming device of claim 15, wherein the average amount is approximately zero.

17. The gaming device of claim 15, wherein the average amount is zero.

18. The gaming device of claim 1, wherein the number of multi-component numerical value offers is predetermined.

19. The gaming device of claim 1, wherein the number of multi-component numerical value offers is randomly determined.

20. The gaming device of claim 1, wherein the at least one input device includes a plurality of numerical value component acceptors and at least one numerical value component acceptor is associated with each of the numerical value components.

21. The gaming device of claim 1, wherein the at least one input device includes at least one numerical value component rejector associated with the numerical value components.

22. The gaming device of claim 1, wherein the at least one input device includes at least one numerical value offer requestor associated with the multi-component numerical value offers.

23. The gaming device of claim 1, wherein the plurality of instructions, when executed by the at least one processor, cause the at least one processor to operate with the at least one display device to simultaneously display the numerical value components of at least one of said multi-component numerical value offers to the player.

24. The gaming device of claim 1, wherein the plurality of instructions, when executed by the at least one processor, cause the at least one processor to operate with the at least one display device to simultaneously display the numerical value components of a plurality of said multi-component numerical value offers to the player.

25. The gaming device of claim 1, wherein the plurality of instructions, when executed by the at least one processor, cause the at least one processor to operate with the at least one display device to simultaneously display the numerical value components of each multi-component numerical value offer to the player.

26. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) select a multi-component numerical value offer from a plurality of at least three multi-component numerical value offers, each of said plurality of multi-component numerical value offers including a plurality of numerical value components, each of said numerical value components including a plurality of numerical value sub-components, wherein an amount of each numerical value component is based on the numerical value sub-components of said numerical value component, and each numerical value component includes at least one variable numerical value sub-component selected from a range of numerical values;

(b) display the selected multi-component numerical value offer by displaying each of the numerical value components and each of the numerical value subcomponents of the selected multi-component numerical value offer;

(c) for each of the plurality of numerical value components of said displayed multi-component numerical value offer, enable a player to independently accept said numerical value component regardless of whether the player accepts any of the other numerical value components;

(d) display the range of numerical values to the player;

(e) if the player has accepted a predetermined number of at least two of said numerical value components of said displayed multi-component numerical value offer:

(i) determine a first award based on the amounts of any accepted numerical value components, and (ii) provide the determined first award to the player;

(f) if the selected multi-component numerical value offer is a final multi-component numerical value component:

(i) determine a second award based on the amounts of any accepted numerical value components, and (ii) provide the determined second award to the player; and (g) if the player has not accepted the predetermined number of at least two of said numerical value components of said displayed multi-component numerical value offer and at least one of the plurality of multi-component numerical value offers remains unselected:

(i) select another multi-component numerical value offer from said plurality of multi-component numerical value offers, and (ii) repeat (b) to (q) at least once.

27. The gaming device of claim 26, wherein the plurality of instructions, when executed by the at least one processor, cause the at least one processor to associate a probability of being selected with each value in the range of values.

28. The gaming device of claim 26, wherein the plurality of instructions, when executed by the at least one processor, cause the at least one processor to operate with the at least one display device to display a plurality of ranges of numerical values.

29. The gaming device of claim 26, wherein the plurality of instructions, when executed by the at least one processor, cause the at least one processor to simultaneously display the numerical value offer components of each multi-component numerical value offer to the player.

30. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) select a multi-component numerical value offer from a plurality of at least three multi-component numerical value offers, each of said plurality of multi-component numerical value offers including a plurality of numerical value components, each of said numerical value components including at least one static numerical value sub-component and at least one variable numerical value sub-component, wherein each numerical value component is based on an amount of the static numerical value sub-components and an amount of the variable numerical value sub-components of said numerical value component;

(b) display the selected multi-component numerical value offer by displaying each of the numerical value components and each of the numerical value sub-components of the selected multi-component numerical value offer;

(c) for each of the plurality of numerical value components of said displayed multi-component numerical value offer, enable a player to independently accept said numerical value component regardless of whether the player accepts any of the other numerical value components;

(d) if the player has accepted a predetermined number of at least two of said numerical value components of said displayed multi-component numerical value offer:

(i) determine a first award based on the amounts of any accepted numerical value components, and (ii) provide the determined first award to the player;

(e) if the selected multi-component numerical value offers is a final multi-component numerical value offer:

(i) determine a second award based on the amounts of any accepted numerical value components, and (ii) provide the determined second award to the player; and (f) if the player has not accepted the predetermined number of at least two of said numerical value components of said displayed multi-component numerical value offer and at least one of the plurality of multi-component numerical value offers remains unselected:

(i) select another multi-component numerical value offer from said plurality of multi-component numerical value offers, and (ii) repeat (b) to (f) at least once.

31. The gaming device of claim 30, wherein the plurality of instructions, when executed by the at least one processor, cause the at least one processor to change the variable value numerical sub-component in each multi-component numerical value offer.

32. The gaming device of claim 30, wherein the plurality of instructions, when executed by the at least one processor, cause the at least one processor to change the variable numerical value sub-component after a plurality of multi-component numerical value offers.

33. The gaming device of claim 30, wherein the plurality of instructions, when executed by the at least one processor, cause the at least one processor to change the variable numerical value sub-component by at least one amount selected from the group consisting of: a predetermined amount, a random amount, a range of numerical values and an average amount.

34. The gaming device of claim 33, wherein the average amount is approximately zero.

35. The gaming device of claim 33, wherein the average amount is zero.

36. The gaming device of claim 33, wherein the plurality of instructions, when executed by the at least one processor, cause the at least one processor to associate the variable numerical value sub-component with a range of numerical values.

37. The gaming device of claim 36, wherein a probability of being selected is associated with each numerical value in the range of numerical values.

38. The gaming device of claim 36, wherein the plurality of instructions, when executed by the at least one processor, cause the at least one processor to operate with the at least one display device to display the range of values.

39. The gaming device of claim 30, wherein the amount of each of the numerical value components equals the static numerical value sub-component multiplied by the variable numerical value sub-component of said numerical value component.

40. The gaming device of claim 30, wherein the plurality of instructions, when executed by the at least one processor, cause the at least one processor to cause the numerical value components to increase, decrease or remain unchanged for each of a plurality of the multi-component numerical value offers.

41. The gaming device of claim 30, wherein the plurality of instructions, when executed by the at least one processor, cause the at least one processor to change the numerical value components for each of a plurality of the multi-component numerical value offers by at least one amount selected from the group consisting of: a predetermined amount, a random amount, an amount in a range of numerical values and an average amount.

42. The gaming device of claim 41, wherein the average amount is approximately zero.

43. The gaming device of claim 41, wherein the average amount is zero.

44. The gaming device of claim 30, wherein the number of multi-component numerical value offers is predetermined.

45. The gaming device of claim 30, wherein the number of multi-component numerical value offers is randomly determined.

46. The gaming device of claim 30, wherein the at least one input device includes a plurality of numerical value component acceptors and at least one numerical value component acceptor is associated with each of the numerical value components.

47. The gaming device of claim 30, wherein the at least one input device includes at least one numerical value component rejector associated with the numerical value components.

48. The gaming device of claim 30, wherein the at least one input device includes at least one numerical value offer requestor associated with the numerical value offers.

49. The gaming device of claim 30, wherein the plurality of instructions, when executed by the at least one processor, cause the at least one processor to operate with the at least one display device to simultaneously display the numerical value offer numerical value components of each multi-component numerical value offer to the player.

50. A gaming device operable under the control of a processor, said gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) select a price offer from a plurality of at least three price offers, each of said price offers including a plurality of numerical value components, each of said numerical value components including a plurality of numerical value sub-components, said numerical value sub-components including at least one numerical unit quantity and at least one numerical unit price, wherein an amount of each numerical value component is based on the numerical unit quantity and the numerical unit price of said numerical value component;

(b) display the selected price offer by displaying each of the numerical value components and each of the numerical value sub-components of the selected price offer;

(c) for each of the plurality of numerical value components of said displayed price offer, enable a player to independently accept said numerical value component regardless of whether the player accepts any of the other numerical value components;

(d) if the player has accepted a predetermined number of at least two of said numerical value components of said displayed price offer:

(i) determine a first total value based on the numerical unit quantity and the numerical unit price of each of the accepted components, and (ii) provide the determined first total value to the player;

(e) if the selected price offer is a final price offer:

(i) determine a second total value based on the numerical quantity and the numerical unit price of each of the accepted components; and (ii) provide the determined second total value to the player; and (f) if the player has not accepted the predetermined number of at least two of said numerical value components of said displayed price offer and at least one of the plurality of price offers remains unselected:

(i) select another price offer from said plurality of price offers, and (ii) repeat (b) to (f) at least once.

51. The gaming device of claim 50, wherein the plurality of instructions, when executed by the at least one processor, cause the at least one processor to increase or decrease at least one of the numerical unit quantities by a random amount for each of a plurality of the price offers.

52. The gaming device of claim 51, wherein the plurality of instructions, when executed by the at least one processor, cause the at least one processor to associate the amount of the increase or decrease of the numerical unit quantity with a probability of being selected.

53. The gaming device of claim 50, wherein the plurality of instructions, when executed by the at least one processor, cause the at least one processor to associate the numerical unit quantities with probabilities of being selected.

54. The gaming device of claim 50, wherein the plurality of instructions, when executed by the at least one processor, cause the at least one processor to associate the numerical unit prices with probabilities of being selected.

55. The gaming device of claim 50, wherein the plurality of instructions, when executed by the at least one processor, cause the at least one processor to associate the numerical unit prices with a range of numerical unit prices.

56. The gaming device of claim 50, wherein the plurality of instructions, when executed by the at least one processor, cause the at least one processor to increase or decrease the numerical unit prices by a random amount.

57. The gaming device of claim 50, wherein the plurality of instructions, when executed by the at least one processor, cause the at least one processor to increase or decrease the numerical unit prices by a static amount in each of said price offers determined from a range of integer values including zero.

58. The gaming device of claim 57, wherein the plurality of instructions, when executed by the at least one processor, cause the at least one processor to associate each integer value with a probability of being selected.

59. The gaming device of claim 57, wherein the average integer value equals zero.

60. The gaming device of claim 57, wherein the average integer value is approximately zero.

61. The gaming device of claim 50, wherein the plurality of instructions, when executed by the at least one processor, cause the at least one processor to increase or decrease the numerical unit prices by a static amount for each of a plurality of the price offers, wherein each increase or decrease is related to the previous increase or decrease in amount.

62. The gaming device of claim 50, wherein the at least one display device includes a price display.

63. The gaming device of claim 62, wherein the plurality of instructions, when executed by the at least one processor, cause the at least one processor to operate with the price display to display a plurality of numerical unit price ranges wherein each of the numerical unit price ranges is associated with one of the units.

64. The gaming device of claim 50, wherein the number of said price offers is predetermined.

65. The gaming device of claim 50, wherein the number of said price offers is randomly determined.

66. The gaming device of claim 65, wherein the plurality of instructions, when executed by the at least one processor, cause the at least one processor to associate the number of said price offers with a probability of being selected.

67. The gaming device of claim 50, wherein the plurality of instructions, when executed by the at least one processor, cause the at least one processor to associate said numerical unit values with probabilities of being associated with the numerical value components.

68. The gaming device of claim 50, wherein the units are shares of stock and the numerical unit prices are share prices associated with said shares of stock.

69. The gaming device of claim 50, wherein the at least one input device includes a plurality of numerical value component acceptors and at least one numerical value component acceptor is associated with each of the numerical value components.

70. The gaming device of claim 50, wherein the at least one input device includes at least one numerical value component rejector associated with the numerical value components.

71. The gaming device of claim 50, wherein the at least one input device includes at least one numerical value offer requestor associated with the price offers.

72. The gaming device of claim 50, wherein the plurality of instructions, when executed by the at least one processor, cause the at least one processor to operate with the at least one display device to display the numerical value components of each price offer to the player.

73. A gaming device operable under the control of a processor, said gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) select a multi-component numerical value offer from a plurality of at least three multi-component numerical value offers, each of said multi-component numerical value offers including a plurality of numerical value components;

(b) display the selected multi-component numerical value offer by displaying each of the numerical value components of said displayed multi-component numerical value offer;

(c) for each multi-component numerical value offer, display a plurality of first numerical value sub-components and a plurality of second numerical value sub-components, wherein the first numerical value sub-components are related to the second numerical value sub-components;

(d) for each of the plurality of numerical value components of said displayed multi-component numerical value offer, enable a player to independently accept said numerical value component regardless of whether the player accepts any of the other numerical value components;

(e) if the player has accepted a predetermined number of at least two of said numerical value components of said displayed multi-component numerical value offer:

(i) determine a first award based on the amounts of any accepted numerical value components, and (ii) provide the determined first award to the player;

(f) if the selected multi-component numerical value offer is a final multi-component numerical value offer:

(i) determine a second award based on the amounts of any accepted numerical value components, and (ii) provide the determined second award to the player; and (g) if the player has not accepted the predetermined number of at least two of said numerical value components of said displayed multi-component numerical value offer and at least one of the plurality of multi-component numerical value offers remains unselected:

(i) select another multi-component numerical value offer from said plurality of multi-component numerical value offers, and (ii) repeat (b) to (g).

74. The gaming device of claim 73, wherein the first numerical value sub-component and the second numerical value sub-component each include a variable numerical value.

75. The gaming device of claim 74, wherein the plurality of instructions, when executed by the at least one processor, cause the at least one processor to change the first and second numerical value sub-components in each multi-component numerical value offer.

76. The gaming device of claim 74, wherein the plurality of instructions, when executed by the at least one processor, cause the at least one processor to cause each variable numerical value sub-component to increase, decrease or remain unchanged in each multi-component numerical value offer.

77. The gaming device of claim 74, wherein the plurality of instructions, when executed by the at least one processor, cause the at least one processor to change a plurality of the variable numerical value sub-components for each of a plurality of the multi-component numerical value offers.

78. The gaming device of claim 74, wherein the at least one input device includes a plurality of numerical value component acceptors and at least one numerical value component acceptor is associated with each of the numerical value components.

79. The gaming device of claim 74, wherein the at least one input device includes at least one numerical value component rejector associated with the numerical value components.

80. The gaming device of claim 74, wherein the at least one input device includes at least one numerical value offer requestor associated with the numerical value offers.

81. The gaming device of claim 74, wherein the at least one input device includes a decision input operable to enable the player to input at least one decision.

82. The gaming device of claim 81, wherein the decision input includes a keyboard.

83. The gaming device of claim 74, wherein the at least one display device is a touch screen.

84. The gaming device of claim 74, wherein the plurality of instructions, when executed by the at least one processor, cause the at least one processor to operate with the at least one display device to simultaneously display the numerical value components of each multi-component numerical value offer to the player.

* * * * *

UNITED STATES PATENT AND TRADEMARK OFFICE

CERTIFICATE OF CORRECTION

PATENT NO. : 7,794,316 B2
APPLICATION NO. : 10/860889
DATED : September 14, 2010
INVENTOR(S) : Palmer et al.

It is certified that error appears in the above-identified patent and that said Letters Patent is hereby corrected as shown below:

In Claim 26, Column 27, line 34, replace "(q)" with --(g)--.

In Claim 30, Column 28, line 22, replace "offers" with --offer--.

Signed and Sealed this

Seventh Day of December, 2010

David J. Kappos

David J. Kappos
*Director of the United States Patent and Trademark Office*